United States Patent [19]

Ariga

[11] Patent Number: 5,014,772

[45] Date of Patent: May 14, 1991

[54] METHOD OF CIRCULATING A HEAT TRANSFER MEDIUM THROUGH A CATERPILLAR AND A PLATE TREATING APPARATUS USING THE CATERPILLAR

[75] Inventor: Masao Ariga, Nagoya, Japan

[73] Assignee: Kabushiki Kaisha Taihei Seisakusho, Aichi, Japan

[21] Appl. No.: 500,746

[22] Filed: Mar. 28, 1990

[30] Foreign Application Priority Data

| | | | |
|---|---|---|---|
| Mar. 30, 1989 | [JP] | Japan | 1-80286 |
| Apr. 7, 1989 | [JP] | Japan | 1-89083 |
| May 23, 1989 | [JP] | Japan | 1-129693 |
| May 27, 1989 | [JP] | Japan | 1-133342 |

[51] Int. Cl.[5] ..... F28D 11/08; F26B 25/00

[52] U.S. Cl. ..... 165/86; 165/120; 34/236

[58] Field of Search ..... 165/86, 120; 432/83; 34/95, 144, 236

[56] References Cited

U.S. PATENT DOCUMENTS

| | | | |
|---|---|---|---|
| 2,133,348 | 10/1938 | Ferenci | 165/86 |
| 2,365,804 | 12/1944 | Clerke | 165/86 |
| 3,402,568 | 9/1968 | Kamin et al. | 165/86 |

FOREIGN PATENT DOCUMENTS

| | | | |
|---|---|---|---|
| 57620 | 8/1912 | Fed. Rep. of Germany | 34/236 |
| 803759 | 2/1951 | Fed. Rep. of Germany | 165/120 |

*Primary Examiner*—John Rivell
*Assistant Examiner*—L. R. Leo
*Attorney, Agent, or Firm*—Ladas & Parry

[57] ABSTRACT

A method of circulating a heat transfer medium through a caterpillar and a plate treating apparatus using the caterpillar. A rotary shaft is arranged to transversely project into the caterpillar arranged in an article conveying direction. The caterpillar is provided with a group of strip shaped hot plates disposed closely in parallel to each other, each hot plate having an inlet and outlet of the heat transfer medium. A heat transfer medium passage is formed in each hot plate to communicate the inlet and the outlet thereof. The rotary shaft includes a heat transfer medium supplying portion and a heat transfer medium discharging portion separately formed therein from one end thereof to the other end. The heat transfer medium is sent from the supplying portion of the rotary shaft to the inlet of each hot plate through a corresponding connecting tube, and then the medium is discharged from the outlet of the hot plate to the discharging portion through another connecting tube. The connecting tubes are long enough to reach turning portions of the caterpillar. The rotary shaft and the caterpillar are synchronously controlled in such a manner that the rotary shaft makes a revolution for a turn of the caterpillar.

32 Claims, 29 Drawing Sheets

METHOD OF CIRCULATING A HEAT TRANSFER MEDIUM THROUGH A CATERPILLAR AND A PLATE TREATING APPARATUS USING THE CATERPILLAR

BACKGROUND OF THE INVENTION

1. Field of the Invention

The present invention relates to a method of circulating a heat transfer medium fluid, such as a heating medium or a cooling medium, through a plurality of hot plate like heat conducting plates which constitute a caterpillar. The present invention further relates to a plate treating apparatus using such a caterpillar.

2. Prior Art

Heretofore, to dry a veneer there have been proposed drying methods using various devices: for example, a dryer circulating hot air transversely or longitudinally of the veneer; a multiplaten press having hot plates vertically or laterally arranged, the hot plates being supplied with a heating medium such as steam, hot oil and warm water; a single platen press having hot plates disposed in a single layer; a continuous press having a steel belt, a mesh belt or a metallic sheet wound around each hot plate in an endless shape; a continuous press having endless chains extended around recesses formed in a pair in an outer surface of a hot plate; and a slat conveyor type press using narrow hot plates.

Dryers are widely used for drying veneers. It is well known that in terms of heat efficiency, a single stage press and a multistage press, which bring hot plates into direct contact with a veneer, are superior to an indirect heating dryer circulating hot air over surfaces of veneer. However, such presses are disadvantageous in that mechanisms to convey a veneer to and away from the hot plates are rather complicated, and in that the veneer is liable to be damaged in moving to and away from the hot plates.

In the continuous press, a veneer is placed on an endless steel belt or a pair of chain conveyers and is turned around to move to a position above a hot plate. After heat dried, the veneer is carried away by turning the steel belt or the chain conveyors. In this manner, automatic carrying in and out of the veneer is achieved. When a belt like member, such as a steel belt, is used in the veneer transporting mechanism, the hot plate makes an indirect heat contact with a veneer for heating, resulting in a low heat efficiency. Moreover, such a heating operation can cause the belt like member to be damaged with the lapse of time. In the veneer transporting mechanism using a pair of chain conveyors, an elevating mechanism is needed. The elevating mechanism is actuated to elevate the chain conveyors or a hot plate every time when a veneer is placed on or taken away from the chain conveyors, and when the veneer is brought into contact with the surface of the hot plate. This is because the veneer is turned over while transported by the conveyors.

In the slat conveyor type press, a group of slats are heated, and hence burners, heaters and like devices are arranged at predetermined positions near the caterpillar for indirect heating of a veneer.

SUMMARY OF THE INVENTION

Accordingly, it is an object of the present invention to provide a method for circulating a heat transfer medium to a caterpillar and a plate treating apparatus using the caterpillar, in which the heat transfer medium is directly supplied into hot plates, which constitute the caterpillar. thereby improving heat efficiency of a plate to be treated without giving damages to the plate to be treated.

It is another object of the present invention to provide a method for circulating a heat transfer medium to a caterpillar and a plate treating apparatus using the caterpillar, in which the heat transfer medium is continuously supplied to the hot plates, so that the hot plates are maintained at a predetermined temperature.

With these and other objects in view, one aspect of the present invention is directed to a method of circulating a heat transfer medium through a caterpillar, comprising the steps of: arranging a rotary shaft to transversely project into the caterpillar arranged in an article conveying direction, the caterpillar including a group of strip-shaped hot plates disposed closely in parallel to each other, the caterpillar including opposite turning portions, each hot plate having a heat transfer medium passage formed therein, each heat transfer medium passage having an inlet and an outlet, the rotary shaft having a heat transfer medium supplying portion and a heat transfer medium discharging portion separately formed therein from one end thereof to the other end; sending the heat transfer medium through connecting tubes from the supplying portion of the rotary shaft to the inlets of the heat transfer medium passages and then from the outlets of the heat transfer medium passages to the discharging portion, the connecting tubes being long enough to reach the turning portions of the caterpillar; and synchronously controlling the rotary shaft and the caterpillar in such a manner that the rotary shaft makes a revolution for a turn of the caterpillar.

According to another aspect of the present invention, there is provided a plate treating apparatus comprising: a pair of parallel frames each having supporting shafts mounted thereto; a pair of upper and lower caterpillars arranged in an article conveying direction, the caterpillars being interposed between the frames with the conveying direction parallel with the frames and oppositely arranged one above the other in an opposing manner, each caterpillar including a pair of chain conveyors, extending around the corresponding supporting shafts spaced in the conveying direction, and a group of parallel strip-shaped hot plates, closely connected together in an endless manner, the group of the hot plates being mounted to the chain conveyors to surround the chain conveyors, each hot plate having an inner surface, and an inlet and an outlet both formed in the inner surface thereof, the inlet and the outlet being communicated through a heat transfer medium passage formed in the hot plate, the caterpillar including opposite turning portions; a pair of heat transfer medium supplying rotary shafts arranged one above the other, each supplying rotary shaft having a proximal portion; supplying rotary shaft connecting tubes, each communicating the supplying rotary shaft to the inlet of each hot plate of a corresponding caterpillar, the connecting tube extendable to the turning portions of the corresponding caterpillar; a pair of heat transfer medium discharging rotary shafts arranged one above the other, each heat transfer medium discharging rotary shaft being communicated to the outlet of each hot plate of the other caterpillar through another connecting tube extendable to the turning portion of the other caterpillar. and each heat transfer medium discharging rotary shaft being supported through a rotary joint to the other frame; discharging rotary shaft connecting tubes, each communicating the discharging rotary shaft to the outlet of each hot plate of a corresponding caterpillar, the connecting tube extendable to the turning portions of the corresponding caterpillar; supporting means for rotatably supporting the heat transfer medium supplying rotary shafts and the heat transfer medium discharging rotary shafts at the proximal portions to respective frames; and synchronous control means for synchronously controlling each rotary shaft and the corresponding caterpillar in such a manner that the rotary shaft makes a revolution for a turn of the caterpillar.

When the caterpillar is actuated, the rotary shaft is synchronously rotated so that the rotary shaft makes one revolution for one turn of the caterpillar. With such a construction, the heat transfer medium is supplied from the heat transfer medium supply portion of the rotary shaft to the heat transfer medium passage of each hot plate for heating or cooling the hot plate. After heat exchange is accomplished, the heat transfer medium is returned from the outlet of the heat transfer medium passage to the heat transfer medium discharge portion of the rotary shaft. Thus, the heat transfer medium is always circulated through each hot plate of the caterpillar which is being turned, and hence the heat transfer medium circulating method and the plate treating apparatus according to the present invention are capable of directly heating or cooling hot plates without any outer heat source.

DETAILED DESCRIPTION OF THE PREFERRED EMBODIMENTS

Figure 1:
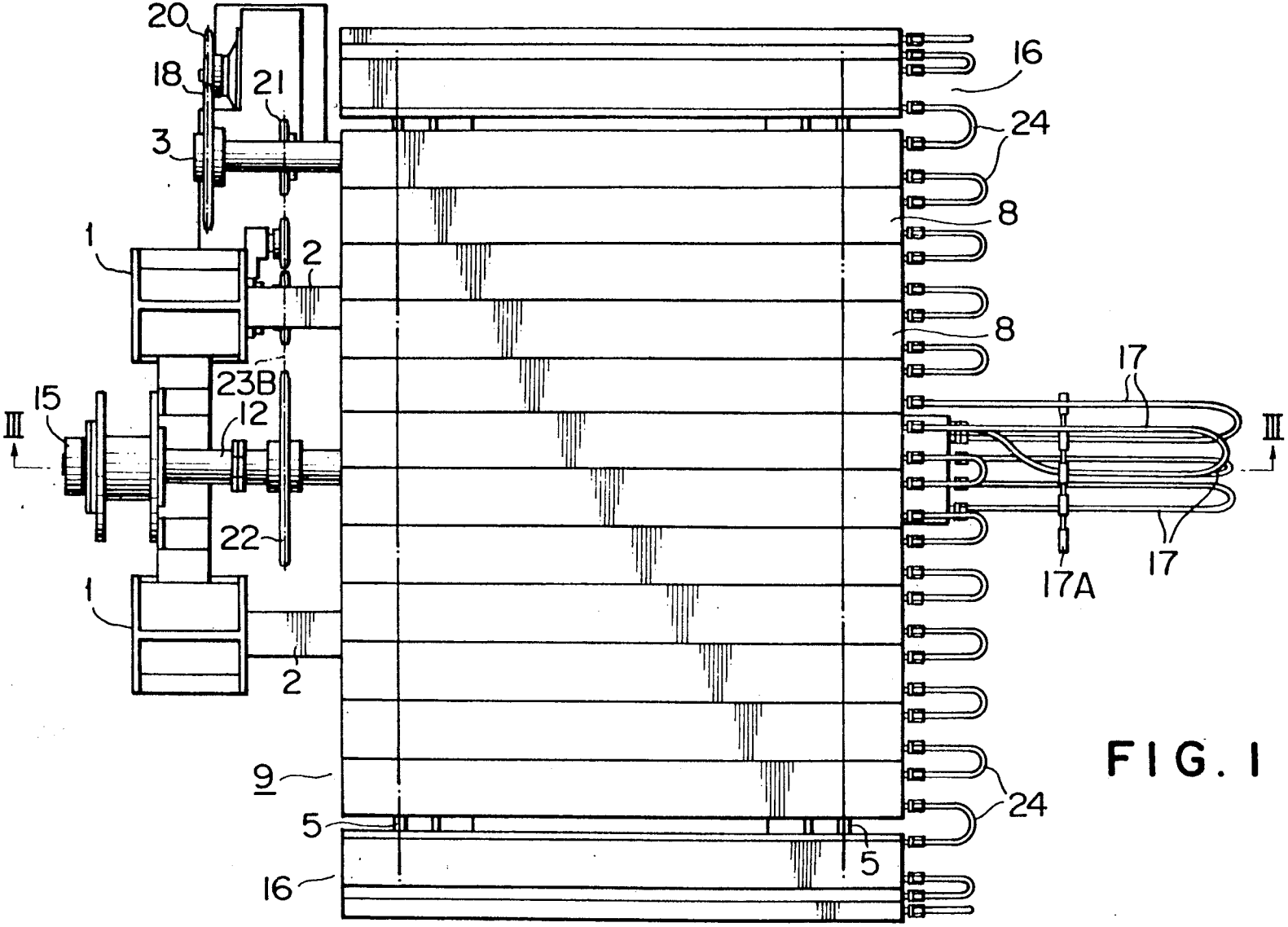
FIG. 1 is a plan view of one embodiment of the present invention.
Figure 2:
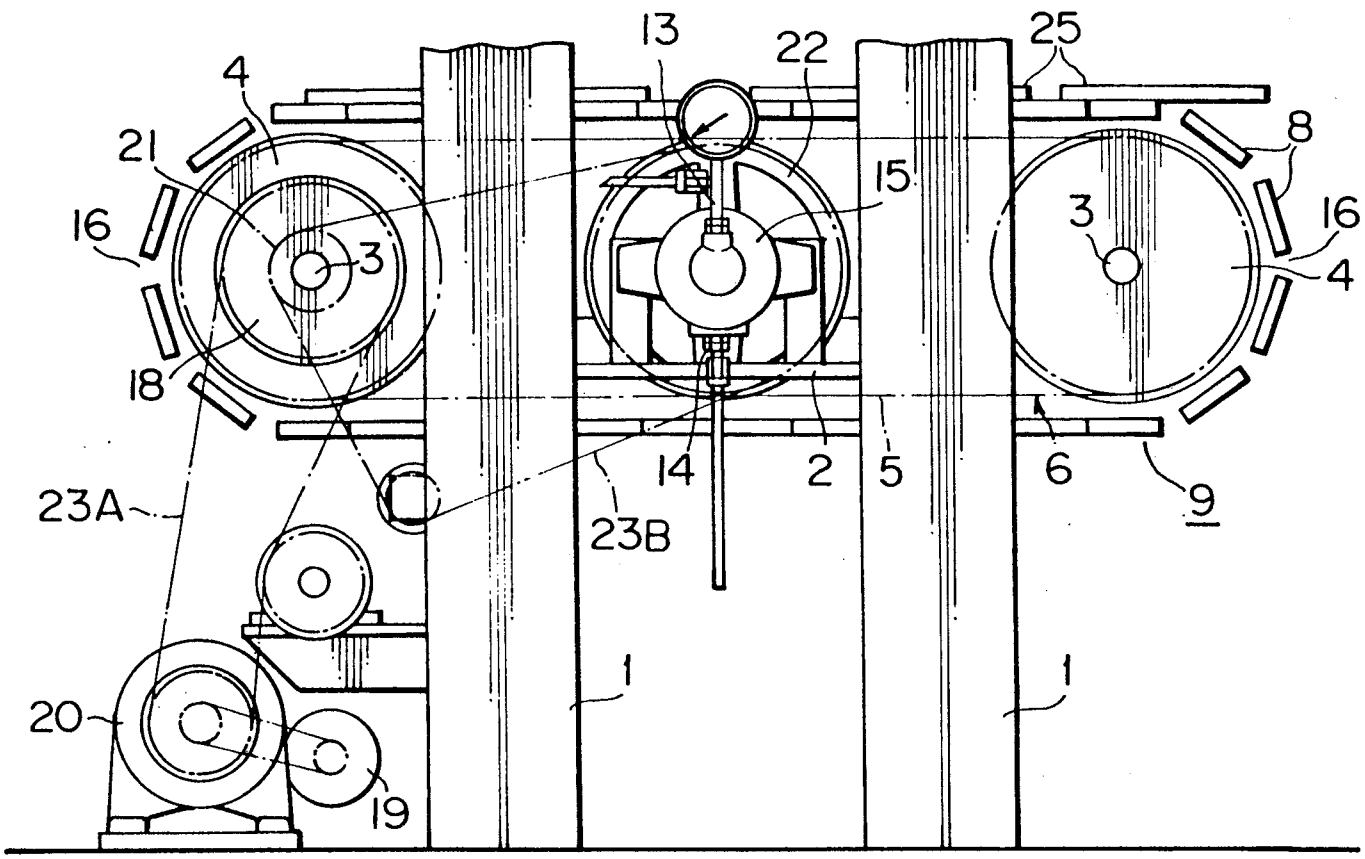
FIG. 2 is a side view of the embodiment in FIG. 1.
Figure 3:
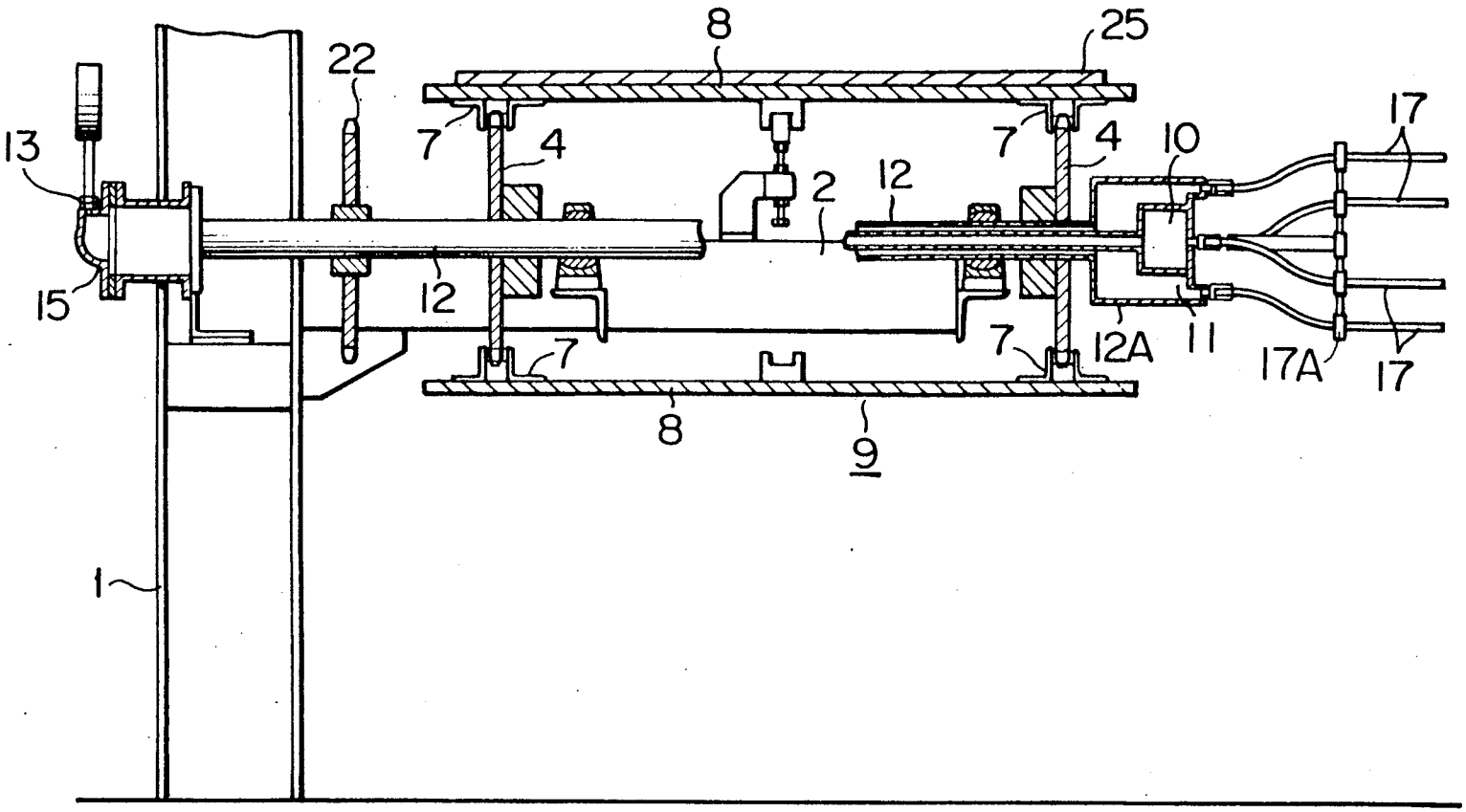
FIG. 3 is a partly taken away view taken along the line III—III in FIG. 1.
Figure 4:
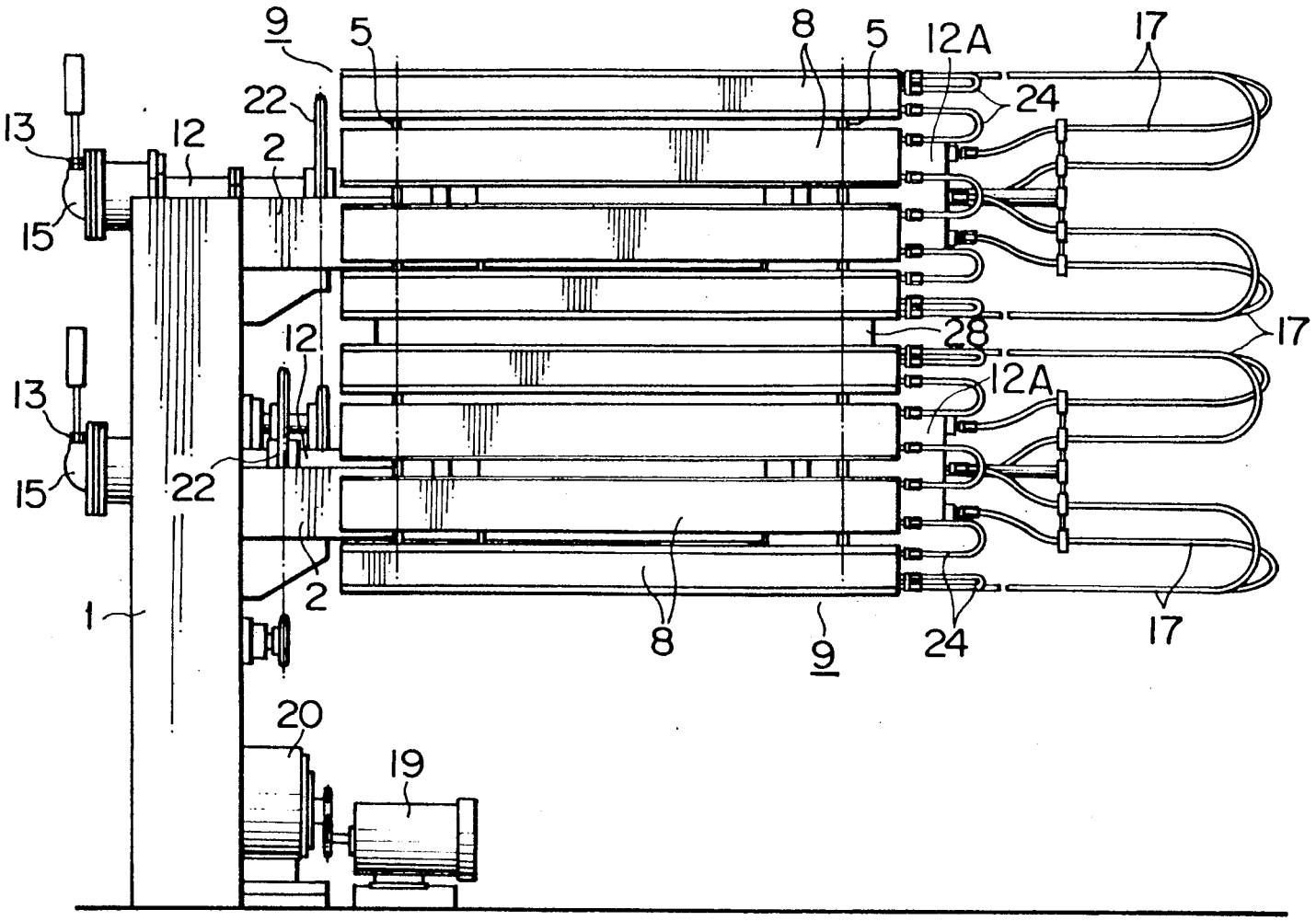
FIG. 4 is a front view of another embodiment in which a pair of caterpillars are one above the other.
Figure 5:
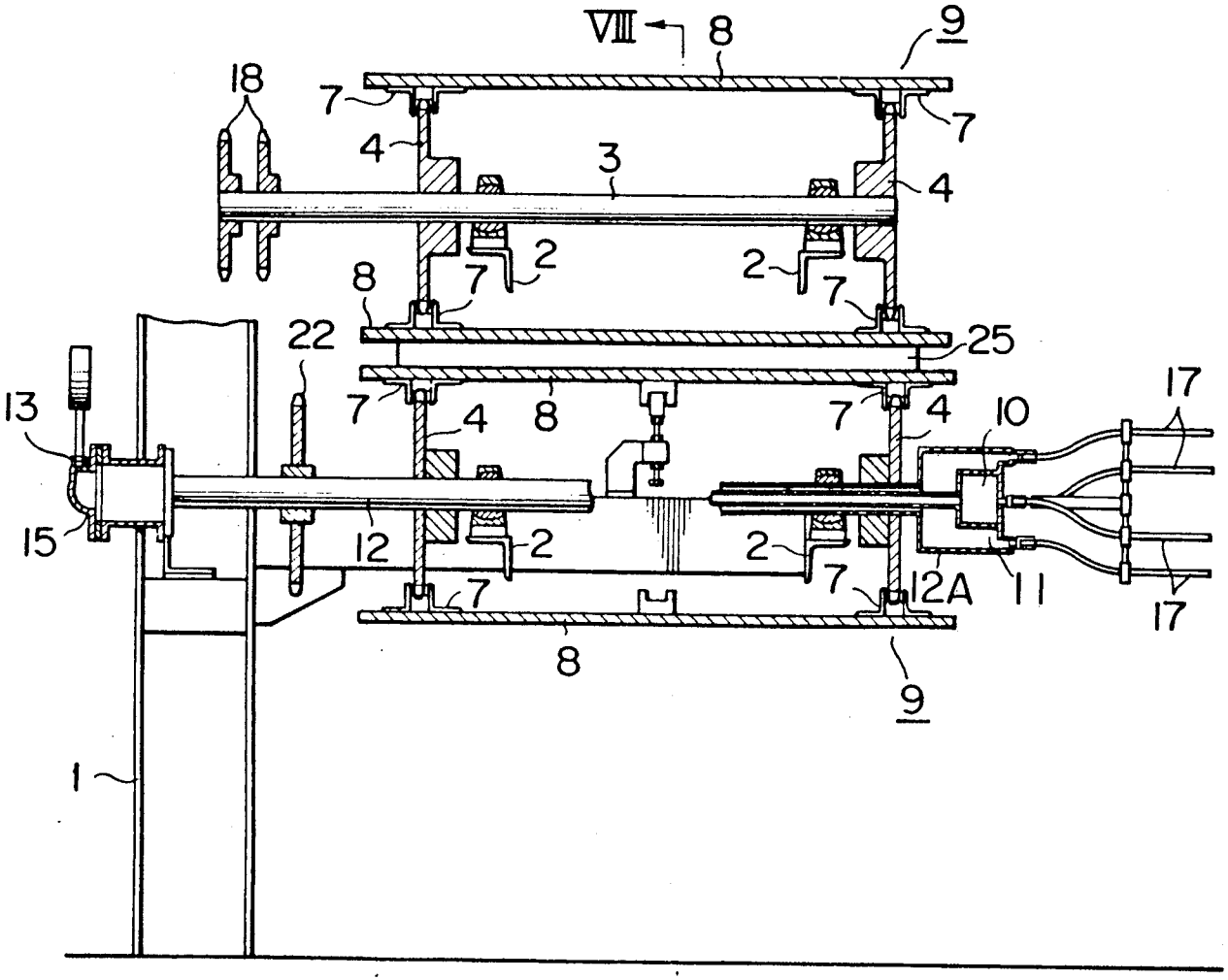
FIG. 5 is a partly taken away vertical section of the plate treating apparatus of FIG. 4.
Figure 6:
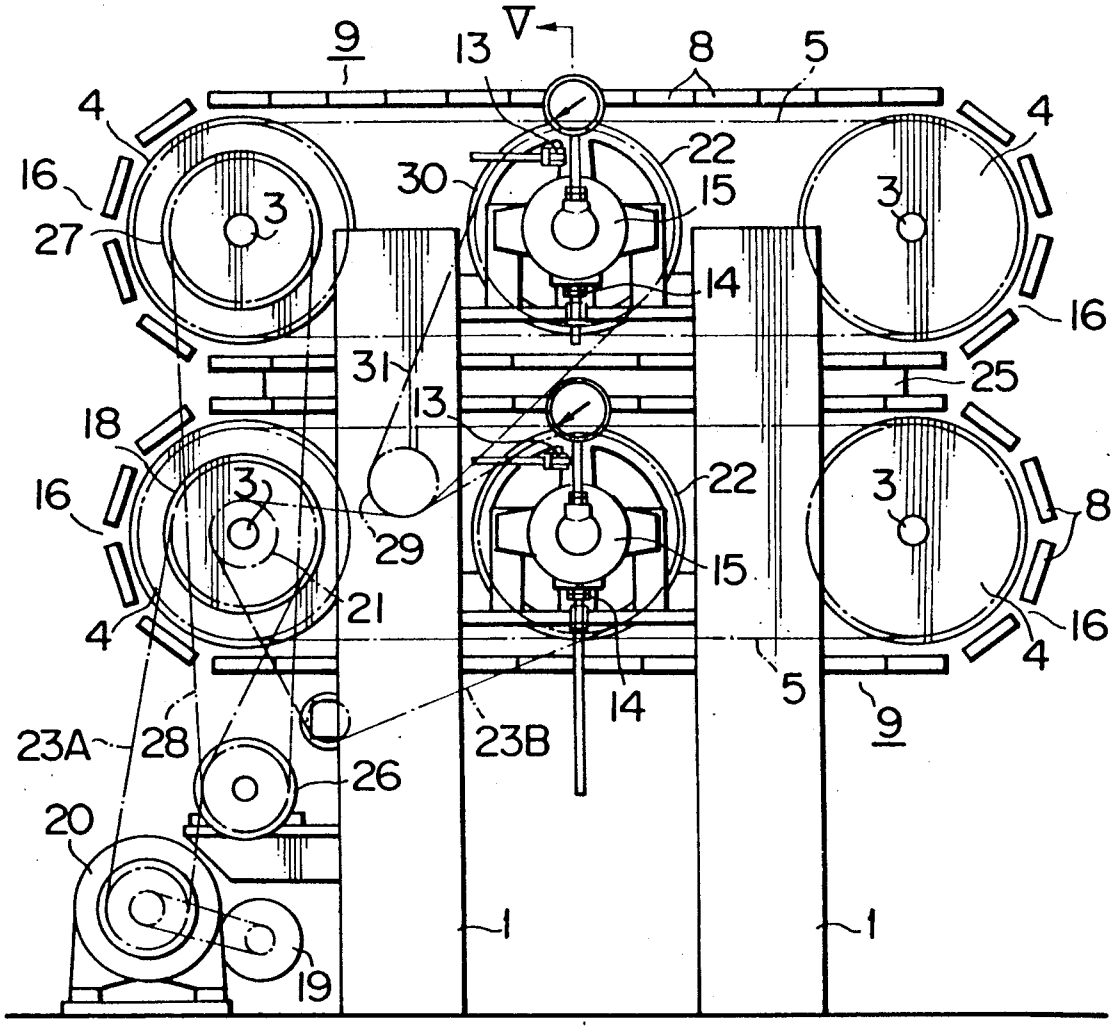
FIG. 6 is a left-hand side view of the plate treating apparatus of FIG. 4.
Figure 7:
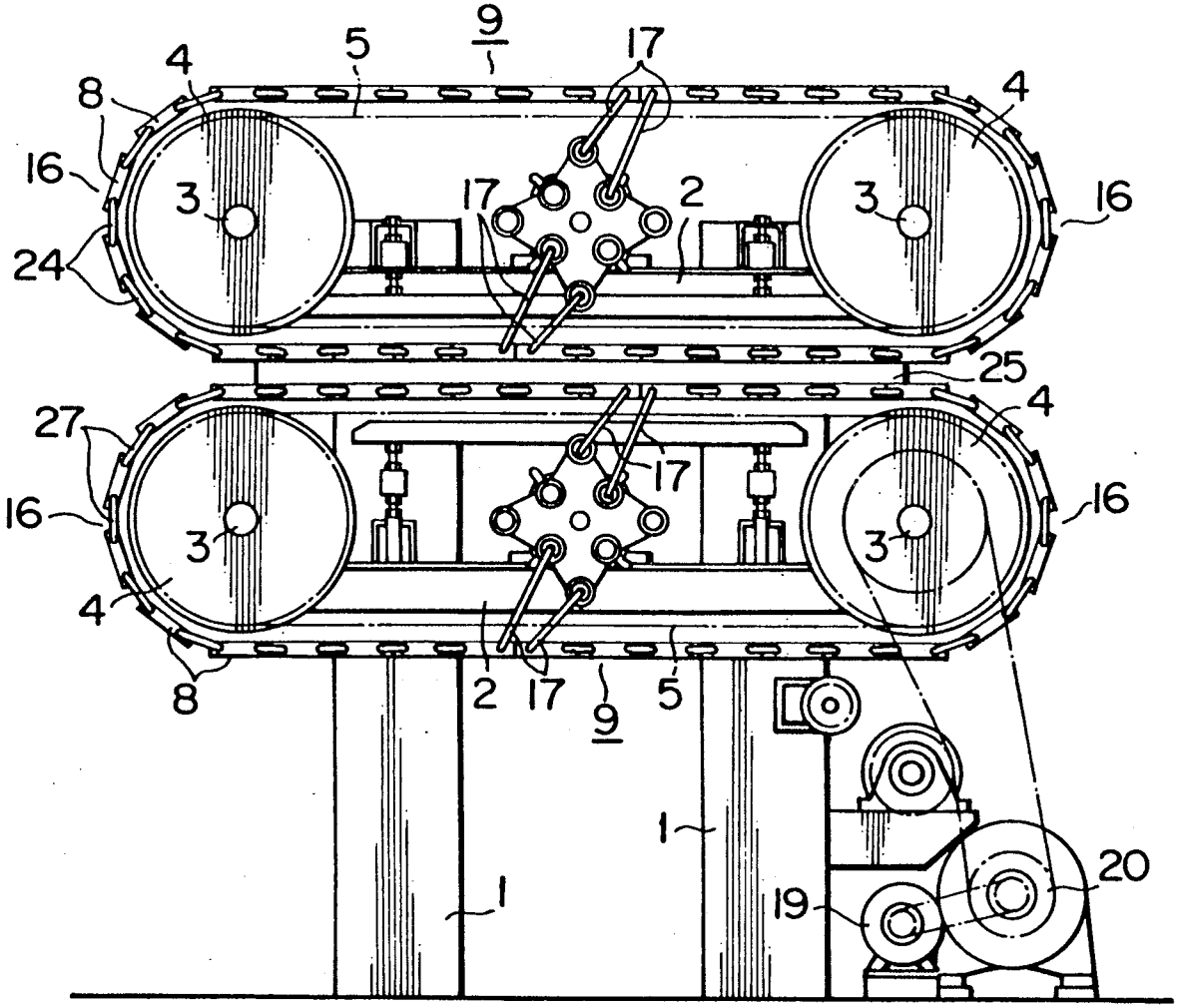
FIG. 7 is a right-hand side view of the embodiment of FIG. 4.
Figure 8:
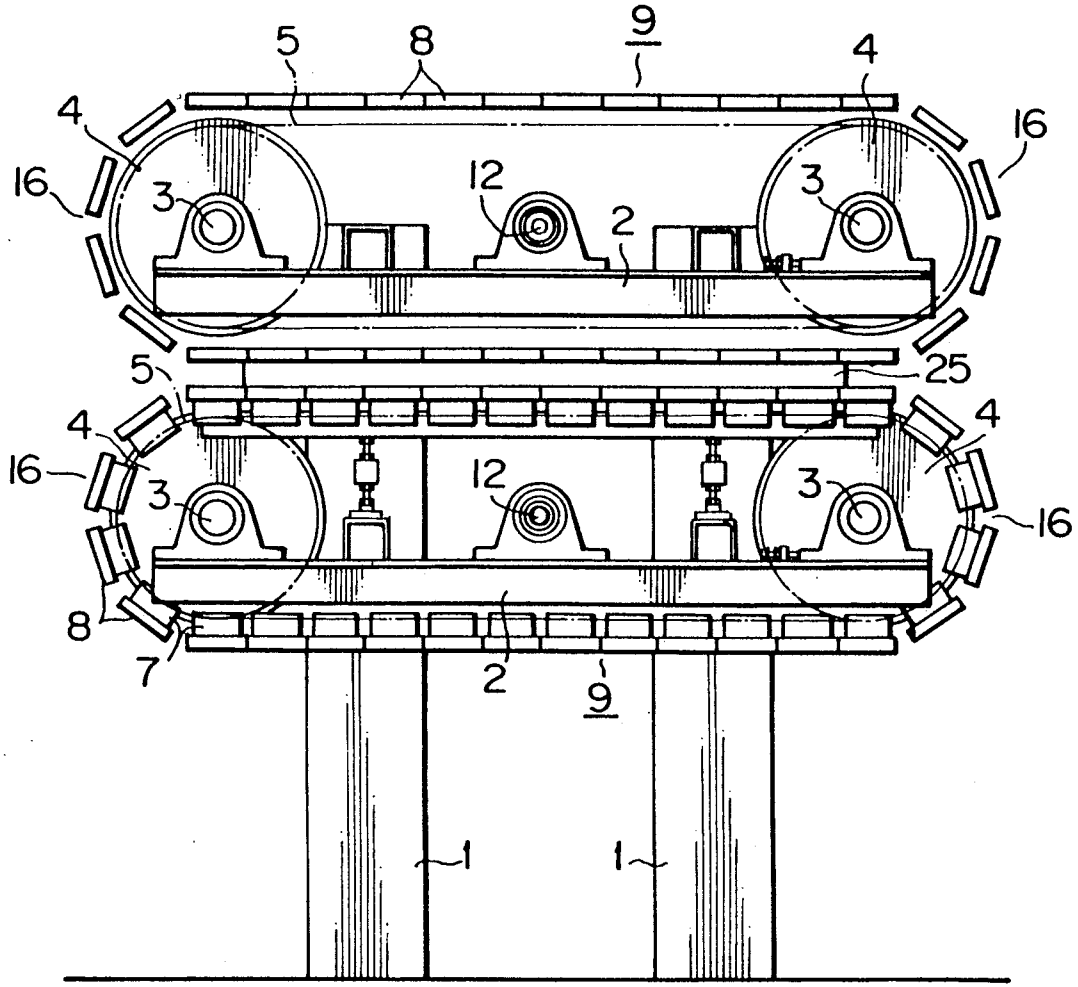
FIG. 8 is a right-hand view in vertical section of the plate treating apparatus of FIG. 4.

FIGS. 1 to 3 illustrate a plate treating apparatus according to the present invention. A plate to be heat dried or cooled (hereinafter referred to as plate to be treated) is placed on the plate treating apparatus and is heat treated while being transported.

A pair of vertical frames 1 and 1 are erected on a floor on one side of a caterpillar 9 of the plate treating apparatus, and a pair of parallel beams 2 and 2 are provided to the vertical frames 1 and 1 in the same horizontal plane to laterally extend. A pair of lateral supporting shafts 3 and 3 are supported on bearings (not shown) which are arranged on beams 2 and 2 in a conveying direction of the caterpillar 9.

The caterpillar 9 is constructed as follows. A pair of sprocket wheels 4 and 4 are mounted on opposite ends of each of the supporting shafts 3 and 3, and a pair of endless chains 5 and 5 extend between sprocket wheels 4 located respective sides of the caterpillar 9 to form a pair of chain conveyors 6 and 6. A multiplicity of parallel strip-shaped hot plates 8 are closely arranged in an endless manner on the chain conveyors 6 and 6 through attachments 7 secured to outer faces of the chains 5, each of the hot plates 8 is provided in it with a heat transfer medium passage through which a heating medium or a coolant (both hereinafter referred to as heat transfer medium) passes. The heat transfer medium passage may be formed in a single row or in rows.

A rotary shaft 12 is rotatably supported by bearings on portions of beams 2 and 2, the portions being surrounded by hot plates 8 of the caterpillar 9. The rotary shaft 12 is provided at is one end with a header 12A. The interior of the header 12A is separated into a heat transfer medium supplying portion 10 and a heat transfer medium discharging portion 11. The other end of the rotary shaft 12 near the vertical frames 1 and 1 has a rotary joint 15 fitted around it. The rotary joint 15 is provided with a supply port 13 and a discharging port 14. Connecting tubes 17 are provided to connect between the heat transfer medium supplying portion 10 and an inlet of the heat transfer medium passage of each hot plate 8 and between the heat transfer medium discharging portion 11 and an outlet of the heat transfer medium passage of each hot plate 8. The connecting tubes 17 have such a length that they reach turning portions 16 of the caterpillar 9. The number of the connecting tubes 17 is the same as the number of the hot plates 8 of the caterpillar 9. In the embodiment of FIGS. 1 to 3, the number of hot plates 8 is 32 and hence that of the connecting tubes 17 is 32. In FIGS. 1 and 3, reference numeral *7a* designates a connecting pipe binder through which connecting tubes 17 pass for preventing them from being caught in each other.

The caterpillar 9 is, as shown in FIG. 2, rotated by transmitting a driving force cf a electric motor 19 to a sprocket wheel 18, mounted around one end of the shaft 3, through a speed reducer 20 and chain 23A. A sprocket wheel 21 which has teeth different in number from the teeth of the sprocket wheel 18 is mounted around the shaft 3. The sprocket wheel 21 is connected to a sprocket wheel 22 on the rotary shaft 12 through a chain 23B in such a manner that one turn of the caterpillar 9 is synchronized with one turn of the rotary shaft 12.

In place of such a mechanical synchronizing mechanism, use may be made of an electrical synchronizing device in which pulse generators are connected to the shaft 3 of the caterpillar 9 and the rotary shaft 12 for electrical synchronization. Although in this embodiment, the caterpillar 9 is horizontally arranged, it may be installed in an inclined manner or in a vertical manner. When the rotary shaft 12 is placed substantially at a center position within the caterpillar 9 as in this embodiment, distances from the rotary shaft 12 to opposite turning portions 16 of the caterpillar 9 are equal and thus the length of the connecting tubes 17 totally becomes short, but the rotary shaft 12 may be located nearer to one of the turning portions 16.

Supplying of the heat transfer medium to and discharging of it from hot plates 8 are not individually made but made in groups of adjacent hot plates 8. In this embodiment, there are two groups of hot plates 8, each group including 16 hot plates 8. In each group, the inlet of the heat transfer medium passage of a leading hot plate 8 is connected to one end of a U-shaped connecting tube 17. The one end of each connecting tube 17 is extendable to the turning portions 16. The outlet of a hot plate 8 and the inlet of an adjacent hot plate 8 of the same group are communicated through a U-shaped connecting joint 24 as shown in FIG. 1. The outlet of the heat transfer medium passage of a trailing hot plate 8 of the group is communicated to the heat transfer medium discharging portion 11 of the rotary shaft 12 through another connecting tube 17. With such a heat transfer medium circulating unit, only two connecting tubes 17 are used in each of the heat transfer medium supplying portion 10 and heat transfer medium discharging portion 11, and the diameter of the rotary shaft 12 and particularly the diameter of the portion connecting the connecting tube 17 is reduced.

As the electric motor 19 rotates, the caterpillar 9 and the rotary shaft 12 are synchronously controlled so that the rotary shaft 12 makes one revolution for one turn of the caterpillar 9. The rotary shaft 12 has a circular cross section and hence the peripheral speed and the angular speed thereof are constant. The caterpillar 9 forms a track shaped locus as it turns, and hence the angular speed thereof is not constant although the peripheral speed is constant. Thus, the length of the connecting .tubes 17 must be variable due to the difference In focus between the caterpillar 9 and the rotary shaft 12. To meet this requirement, the connecting tubes 17 may use an extendable mechanism, for example, a telescopic cylinder, which can extend from the rotary shaft 12 to the turning portions 16. To prevent twisting of the connecting tubes 17 due to difference in angular speed between the two members, the connecting tubes 17 may be connected through rotary points between the hot plates 8 and the rotary shaft 12.

Flexible pipes are preferably used for the connecting tubes 17 to vary their length and to prevent twisting. When flexible tubes are used as the connecting tubes 17, their flexible portions gradually extend as hot plates 8 to which they are connected moves from positions nearest to the rotary shaft 12 to turning portions 16 of the caterpillar, and then the flexible tubes gradually bend. Although torsion is applied to each flexible tube as its one end passes through each turning portion 16, the flexibility of the pipe is capable of overcoming the torsion.

Gaps between adjacent hot plates 8 and 8 become slightly wider at each of the turning portion 16 and 16 than at the other positions. Each of the U-shaped connecting joints 24 which circulate a heat transfer medium through a group of hot plates 8 makes the distance between its legs larger at the turning portions 16. At each turning portion 16, a heat transfer medium is always supplied to and discharged from the rotary shaft 12 through the rotary joint 15. When the plate 25 to be treated is a veneer, a heat transfer medium, such as steam or hot oil, passes through the rotary shaft 12 to dry the veneer. A coolant is always transported through the rotary shaft 12 for maintaining the hot plates 8 at a predetermined temperature when the temperature of a drIed veneer is to drop to a temperature, at which an adhesive is not cured, for applying the adhesive, or when a resin laminated veneer is to be cooled after hot pressed.

FIGS. 4 to 8 illustrate an embodiment in which a pair of caterpillars 9 of the preceding embodiment are arranged one above the other in an opposing manner A plate 25 to be treated is conveyed between the caterpillars 9 and 9 in a sandwiched manner for heating or cooling treatment. The opposite surfaces of the plate 25 to be treated are subjected to a thermal treatment and hence efficiency of the thermal treatment is fairly increased.

In a driving system of the upper caterpillar 9, a sprocket wheel 27 which is mounted around the shaft 3 is connected to a sprocket wheel 26 through a chain 28, the sprocket wheel 26 being engaged with the chain 23A which interconnects the speed reducer 20 to the sprocket wheel 18 of the lower caterpillar 9 to transmit rotation. Thus, the upper and lower caterpillars 9 and 9 are turned at the same speed but in opposite directions.

The driving system of the rotary shaft 12 of the upper caterpillar 9 includes a sprocket wheel 30 which is connected to a sprocket wheel 29 through a chain 31. The sprocket wheel 29 engages the chain 23B of the lower caterpillar 9. This driving system transmits to the rotary shaft 12 of the upper caterpillar 9 rotation with the same speed as and in the opposite direction to the rotation of the rotary shaft 12 of the lower caterpillar 9.

To adapt to a change in thickness of the plate 25 to be treated, the beams 2 and 2, which support the upper and lower caterpillar 9 and its accompanying parts in a cantilever fashion, are capable of changing their vertical positions by a suitable devices (not shown) such as screw mechanisms, hydraulic jacks and a like mechanism.

In the plate treating apparatus, a plate 25 to be treated, such as a veneer, is inserted between the upper and lower caterpillars 9 and 9, so that each of opposite surfaces of the plate 25 to be treated makes a direct contact with the hot plates 8 of the corresponding caterpillar 9. As the caterpillars 9 and 9 turn, the plate 25 to be treated passes through flat portions of the caterpillars 9 and 9 to turning portions 16 and 16. During this operation, the plate treating apparatus is capable of drying the plate 25 to be treated.

Figure 9:
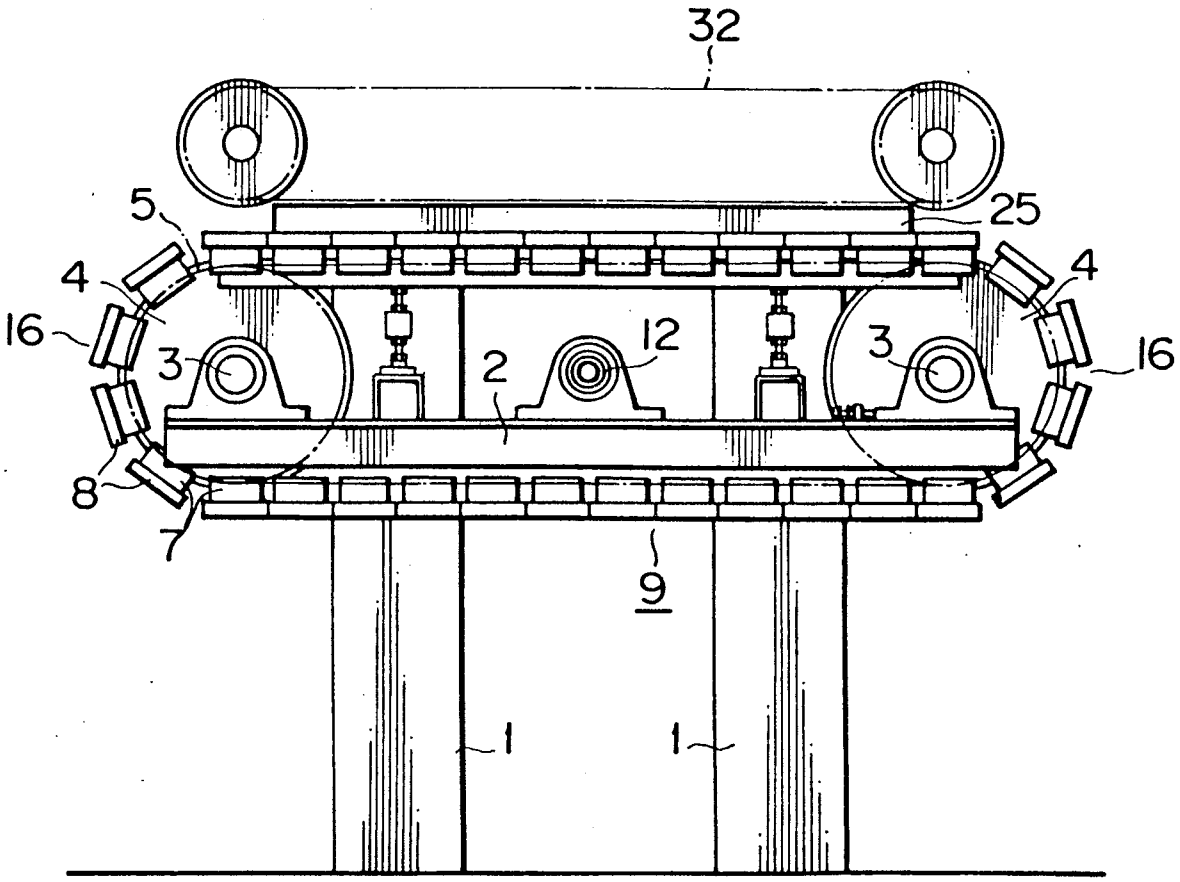
FIG. 9 is a side view illustrating a modified form of the plate treating apparatus of FIG. 4.

In place of the upper caterpillar 9 of the plate treating apparatus of FIGS. 4–8, a depressing conveyor including parallel conveyor belts 32 may be, as shown in FIG. 9, arranged above the lower caterpillar 9 in a parallel manner. In the plate treating apparatus of FIG. 9, a plate 25 to be treated, placed on hot plates 8 of the caterpillar 9, is moved by turning the caterpillar 9. During this movement, the plate 25 to be treated is subjected at its lower surface to a direct thermal influence from hot plates 8 which are maintained at a predetermined temperature. Under such a condition, the upper surface of the plate 25 to be treated is slightly depressed by synchronously turning the depressing conveyor 32 in a direction opposite to the turning direction of the caterpillar 9, so that the depressing conveyor 32 depresses the plate 25 to be treated not to separate from the hot plates. This prevents cracks from being produced in a direction of fibers due to contraction.

Figure 10:
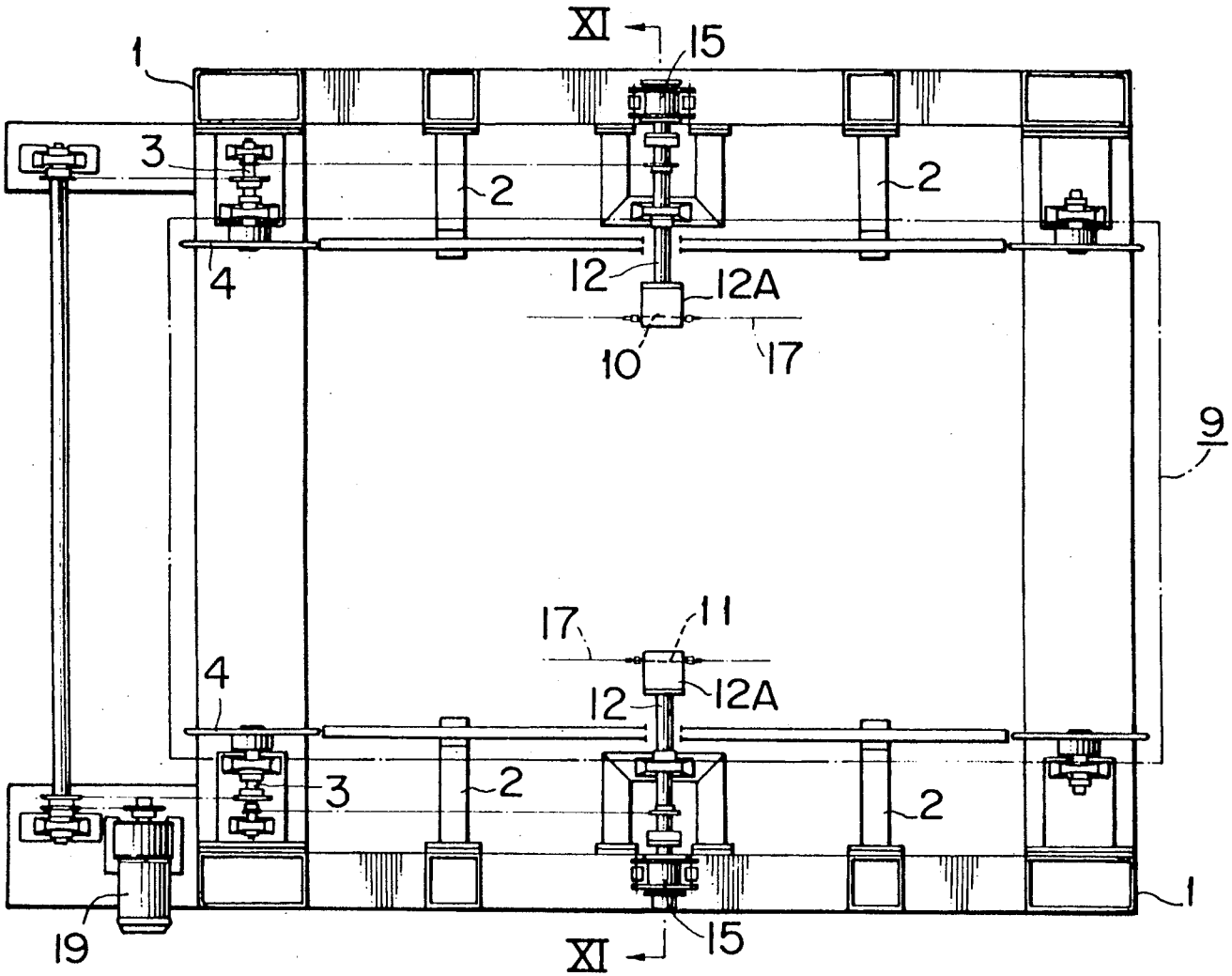
FIG. 10 is a plan view, partly taken away, of another embodiment of the present invention with separate heat transfer medium supplying and discharging systems.
Figure 11:
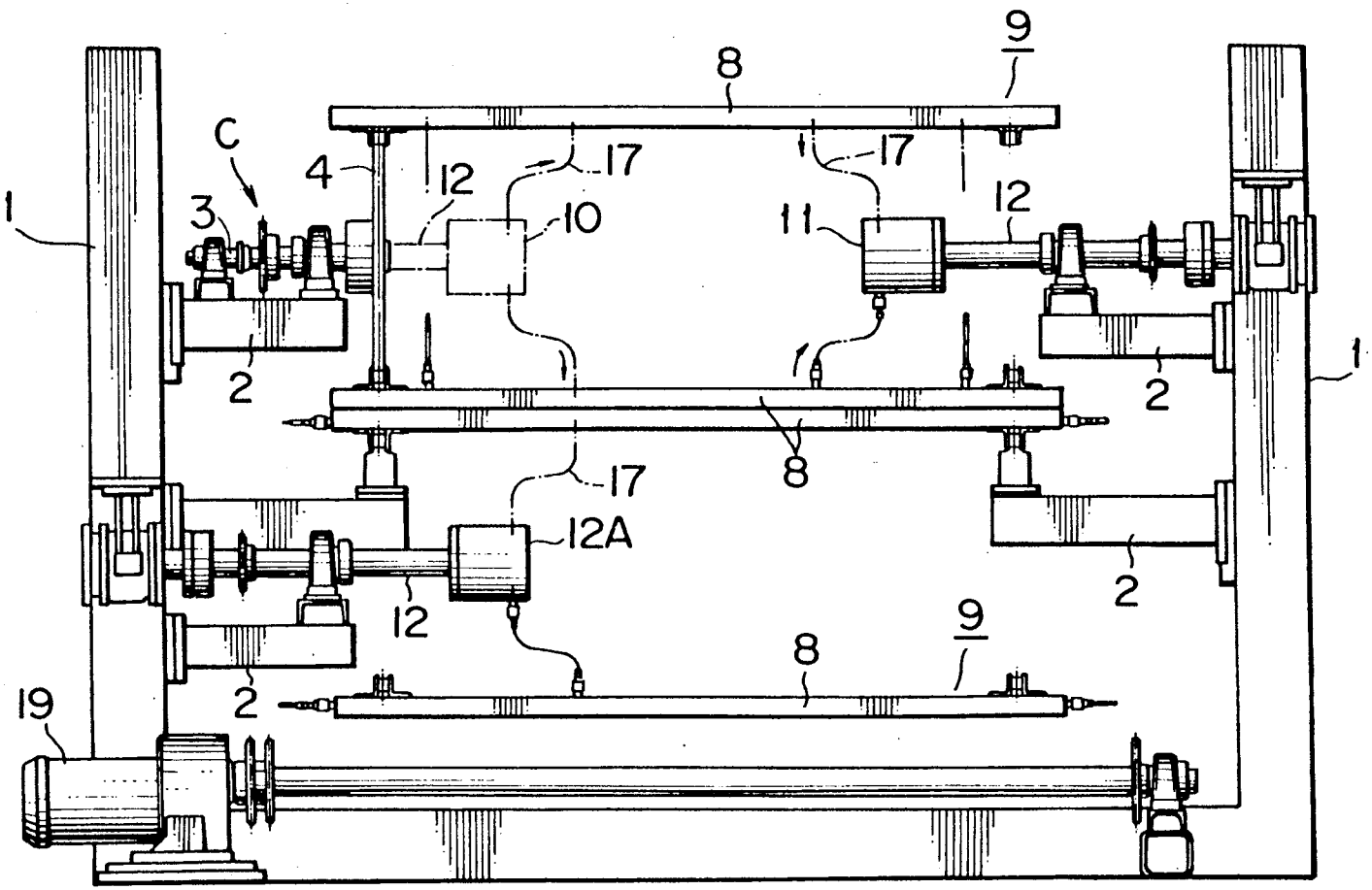
FIG. 11 is an enlarged view taken along the line XI—XI in FIG. 10.
Figure 12:
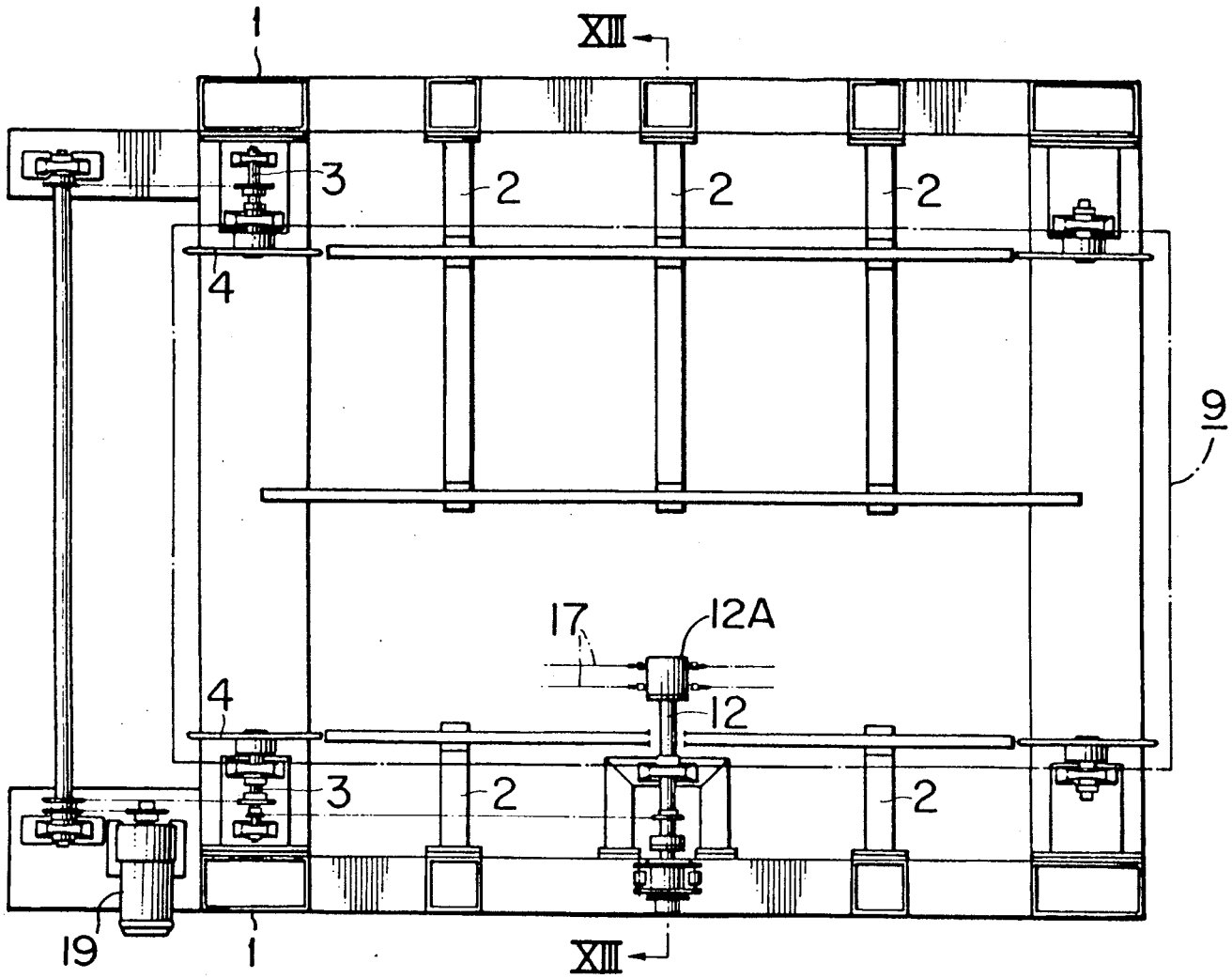
FIG. 12 is a plan view, partly taken away, of still another embodiment of the present invention with a single heat transfer medium supplying and discharging system for each caterpillar.
Figure 13:
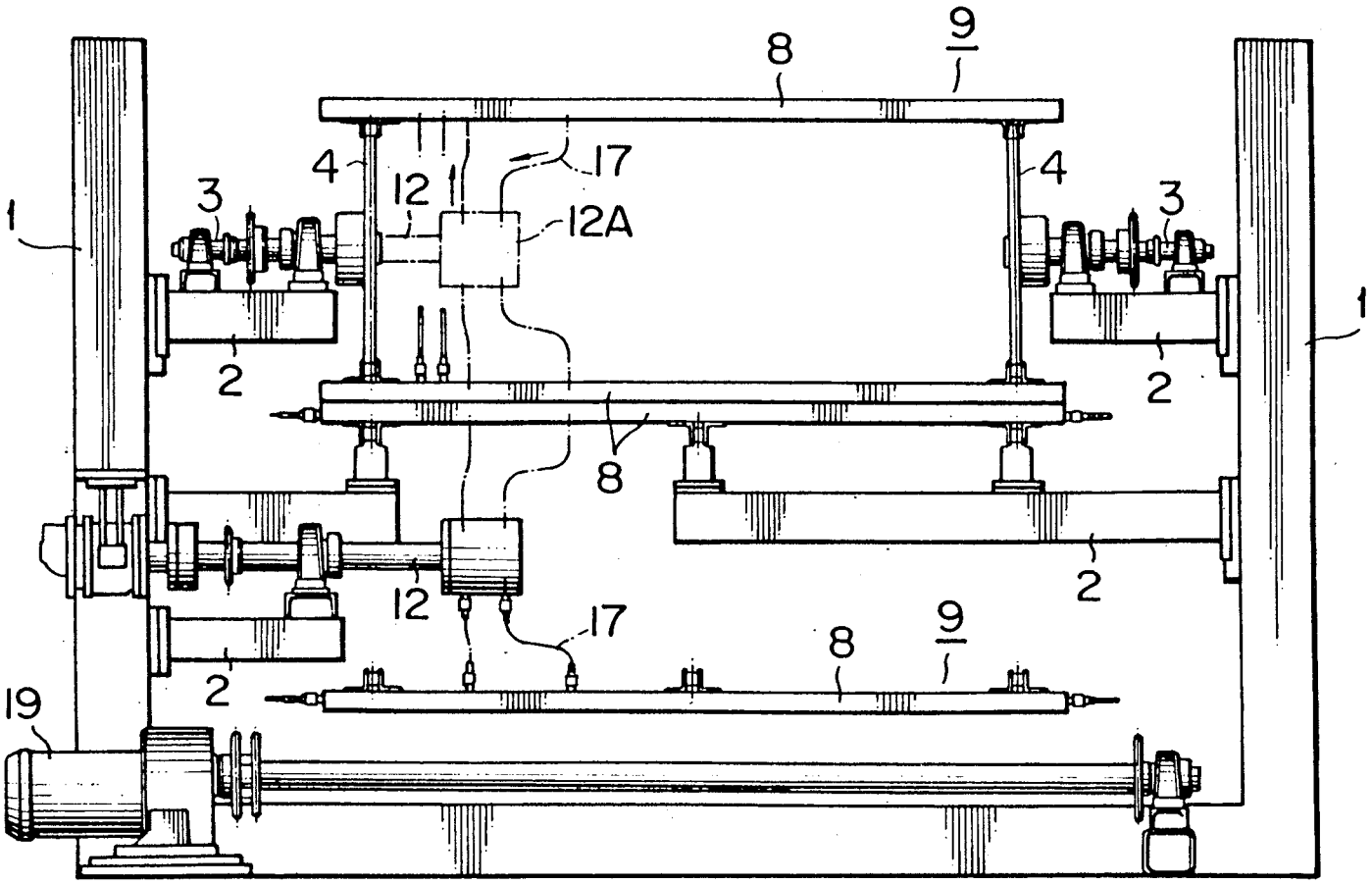
FIG. 13 is an enlarged view taken along the line XIII—XIII of FIG. 12.

FIGS. 10 to 13 illustrate two embodiments in which opposite ends of the supporting shafts 3 and 3 of the sprocket wheels are supported. In each embodiment, a pair of vertical frames 1 and 1 are erected with transverse spacing. Two pairs of beams 2 and 2 are provided to each frame 1 in a vertically spaced manner to extend horizontally for supporting corresponding sprocket wheels 4. In FIG. 11, the rotary shaft 12 of the right side of the lower caterpillar 9 is omitted for illustration purpose.

In each of the caterpillars 9 and 9 of the embodiment of FIGS. 10 and 11, a pair of opposed rotary shafts 12 and 12 are used. Each of the rotary shafts 12 is solely for supplying or discharging a heat transfer medium. In the embodiment in FIGS. 12 and 13, two rotary shafts 12 are provided to only one side frame 1 to supply and discharge a heat transfer medium.

In each of the embodiments of FIGS. 10 to 13, connecting tubes 17 are connected to the inner surfaces of the hot plates 8 and are placed within the caterpillars 9 and 9.

Figure 14:
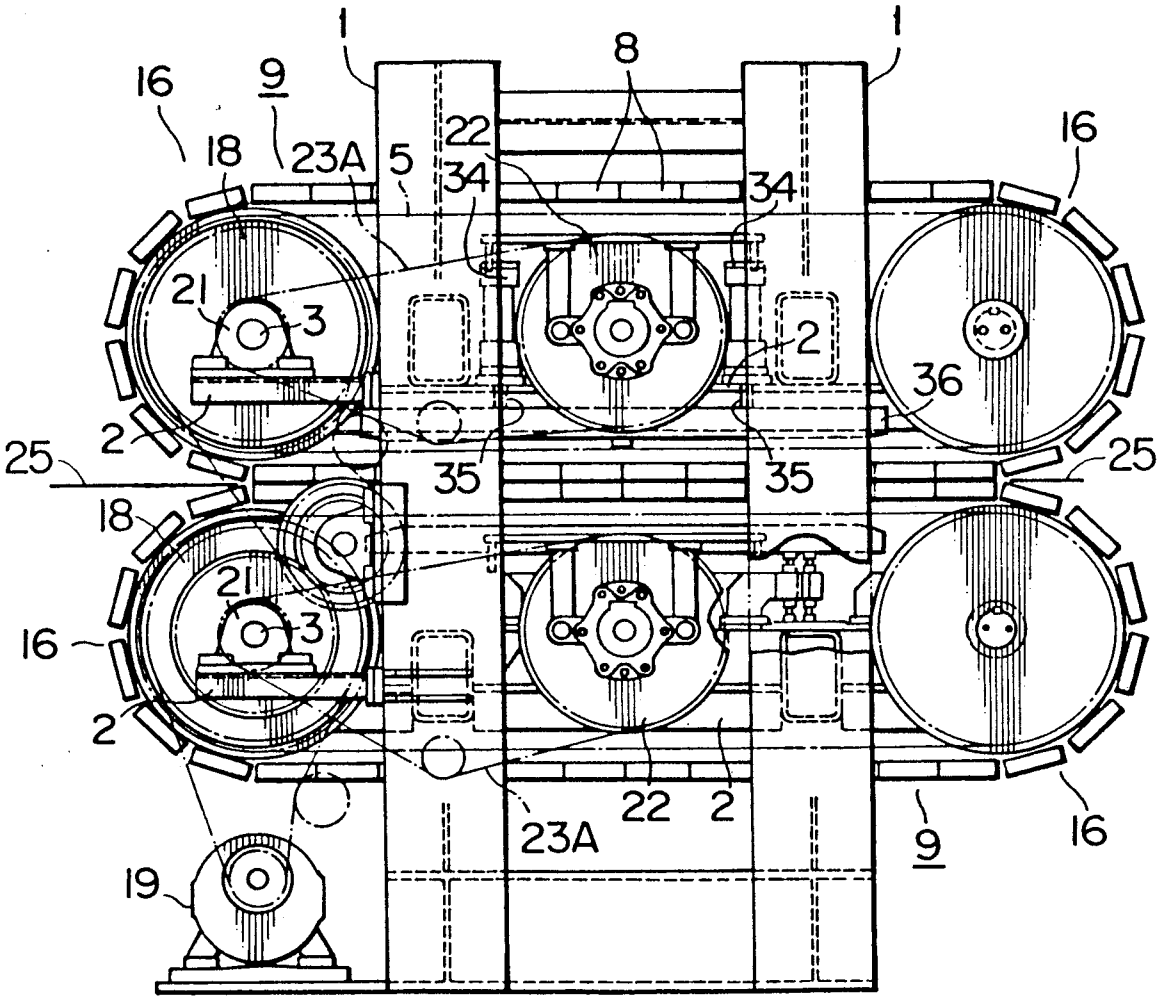
FIG. 14 is a side view of another embodiment of the present invention with a caterpillar having a depressing mechanism.
Figure 15:
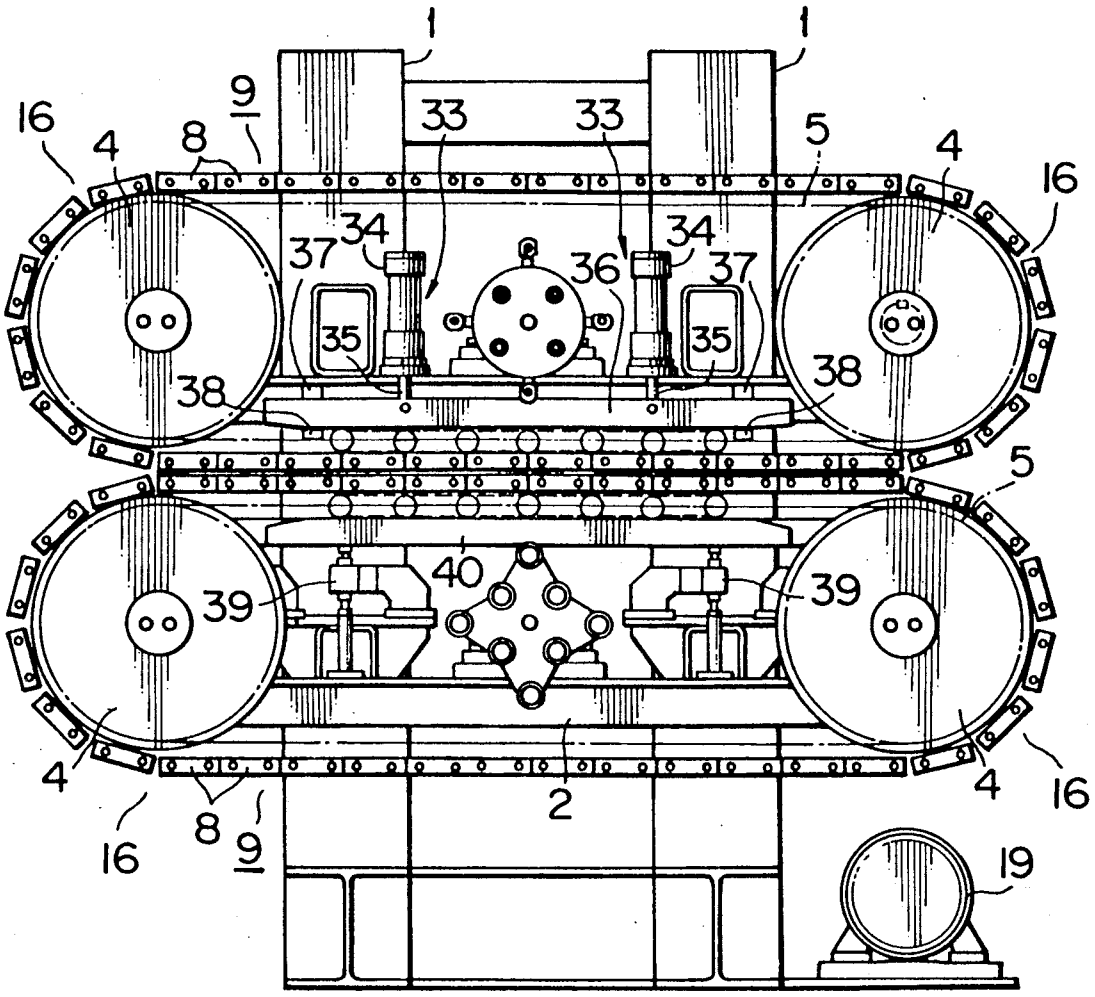
FIG. 15 is a vertical section of the plate treating apparatus of FIG. 14.

In FIGS. 14 and 15, there is illustrated another embodiment, in which hot plates 8 of a pair of caterpillars 9 and 9 are brought into intimate contact to a plate 25 to be treated to improve the efficiency of the thermal processing. A pressing mechanism 33 is provided to a beam 2 of one of the caterpillars 9 and 9 (the upper caterpillar 9 in this embodiment). When the plate 25 to be treated is a plywood board to which a glue is applied, the pressing mechanism 33 enhances the bonding thereof.

The pressing mechanism 33 includes a pair of fluid cylinders 34 and 34 mounted to the beam 2 in a direction perpendicular to the adjacent hot plates 8. A piston rod 35 of each fluid cylinder 34 is fastened at its lower end to one of two pressing bars 36 and 36 (only one of which is shown) through a joint member not shown. The pressing bars 36 and 36 extend in the conveying direction of the plate 25 to be treated.

Two pairs of pendants 37 and 37 are provided to depend from the beam 2 of the upper caterpillar 9. Each pair of pendants 37 and 37 slidably pass through the corresponding pressing bar 36. A locking nut 38 is threaded to the lower end of each pendant 37 to adjust the limit of depressing link portions of the chain 5 to which hot plates 8 are attached. Instead of fluid cylinders 34 conventional crank mechanisms, screw mechanisms or springs may be used.

Figure 16:
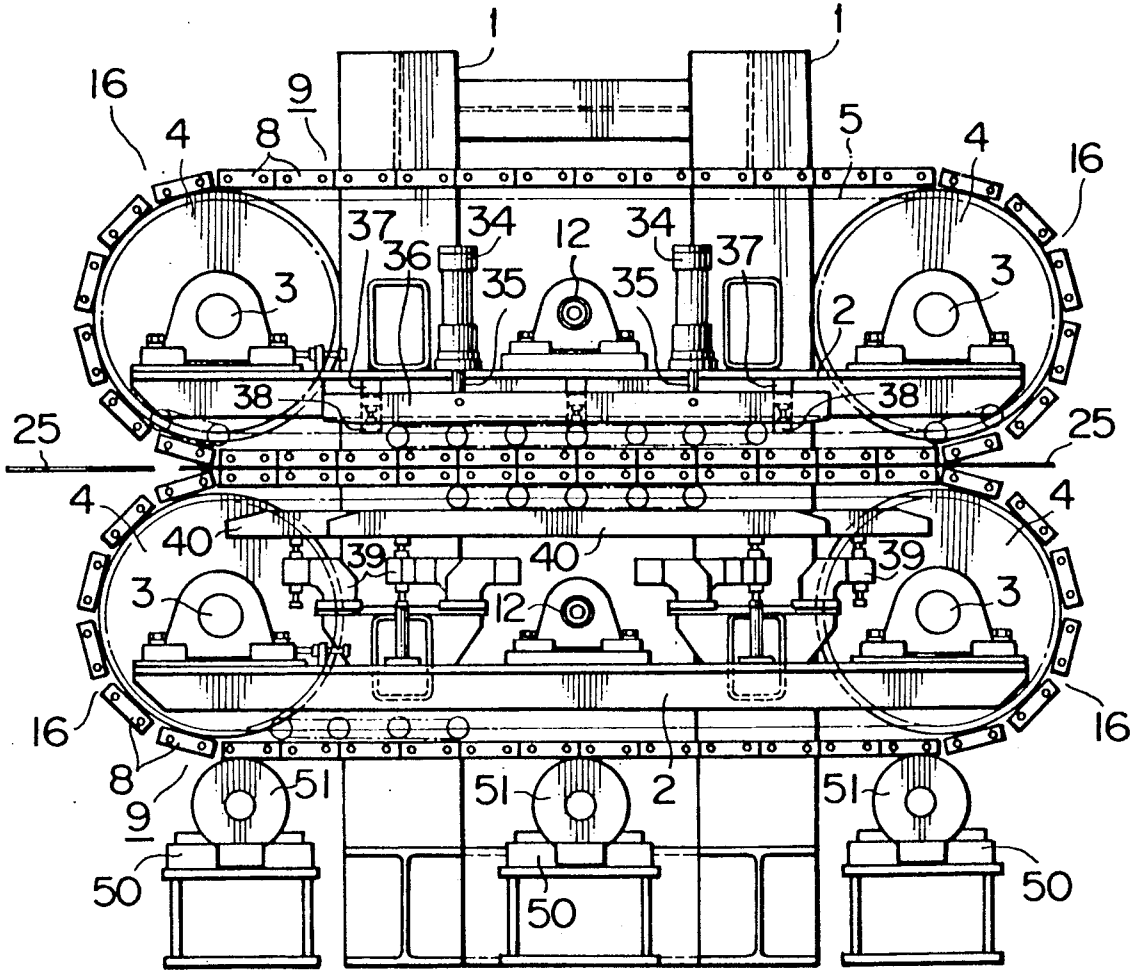
FIG. 16 is a vertical section of a modified form of the plate treating apparatus of FIG. 14.

In the lower caterpillar 9, three pairs of supporting members 39 and 39 are supported on the beam 2 in a threaded manner for adjustment of vertical positions thereof although two pairs of supporting members 39 and 39 are shown in FIG. 16. Two pairs of supporting members 39 and 39 are arranged right below the pressing bars 36 and 36, respectively, and the other one pair is located at a center position of the lower caterpillar 9. Each pair of supporting members 39 and 39 are connected at their upper ends to a supporting bar 40 which is in contact with a link portion of the chain 5 of the lower caterpillar 9. The supporting members 39 and 39 serve to bear reaction forces of the upper caterpillar 9 through the supporting bars 40.

With such a construction, the lower limit of the hot plates which constitute caterpillars 9 and 9 is determined by turning the locking nuts 38 threaded around pendants 37 according to the thickness of the plate 25 to be treated.

In this condition, the piston rods 35 of the fluid cylinders 34 are extended to lower the pressing bars 36. This produces a predetermined pressure between the pressing bars 36 and the supporting bars 40 of the lower caterpillar 9. When a plate 25 to be treated is inserted between the upper and lower caterpillars 9 and 9, opposite surfaces of the plate 25 to be treated come into direct contact with hot plates 8 of the caterpillars 9 and 9 under pressure, and as the caterpillars 9 and 9 turn, the plate 25 to be treated moves through flat portions thereof to a delivery position at one of the turning portions 16 and 16 of each caterpillar. The plate 25 treated is taken out from the delivery position.

The caterpillars 9 and 9 of FIGS. 14 and 15 are supported on frame 1 in a cantilever fashion. To horizontally maintain the traveling plane of the plate 25 to be treated, a reaction force bearing mechanism may be provided for bearing the upper and lower caterpillars 9 and 9, and is preferably arranged at the sides of the caterpillars 9 and 9 remote from the frame 1. As the reaction force bearing mechanism, a strut, using trains of rollers, or a conveyor including a wide endless belt may be provided in such a manner that the upper traveling surface thereof makes a contact with the lower traveling plane of the lower caterpillar 9. Alternatively, supporting members including discs 51 may be, as illustrated in FIG. 16, arranged to bear the lower traveling plane of lower caterpillar 9, each disc being supported on a pair of rails 50. The discs 51 are located at least positions just below supporting shafts 3 of the caterpillars 9 and may be also arranged on the side of frame 1 to totally bear vertical reaction forces.

Figure 17:
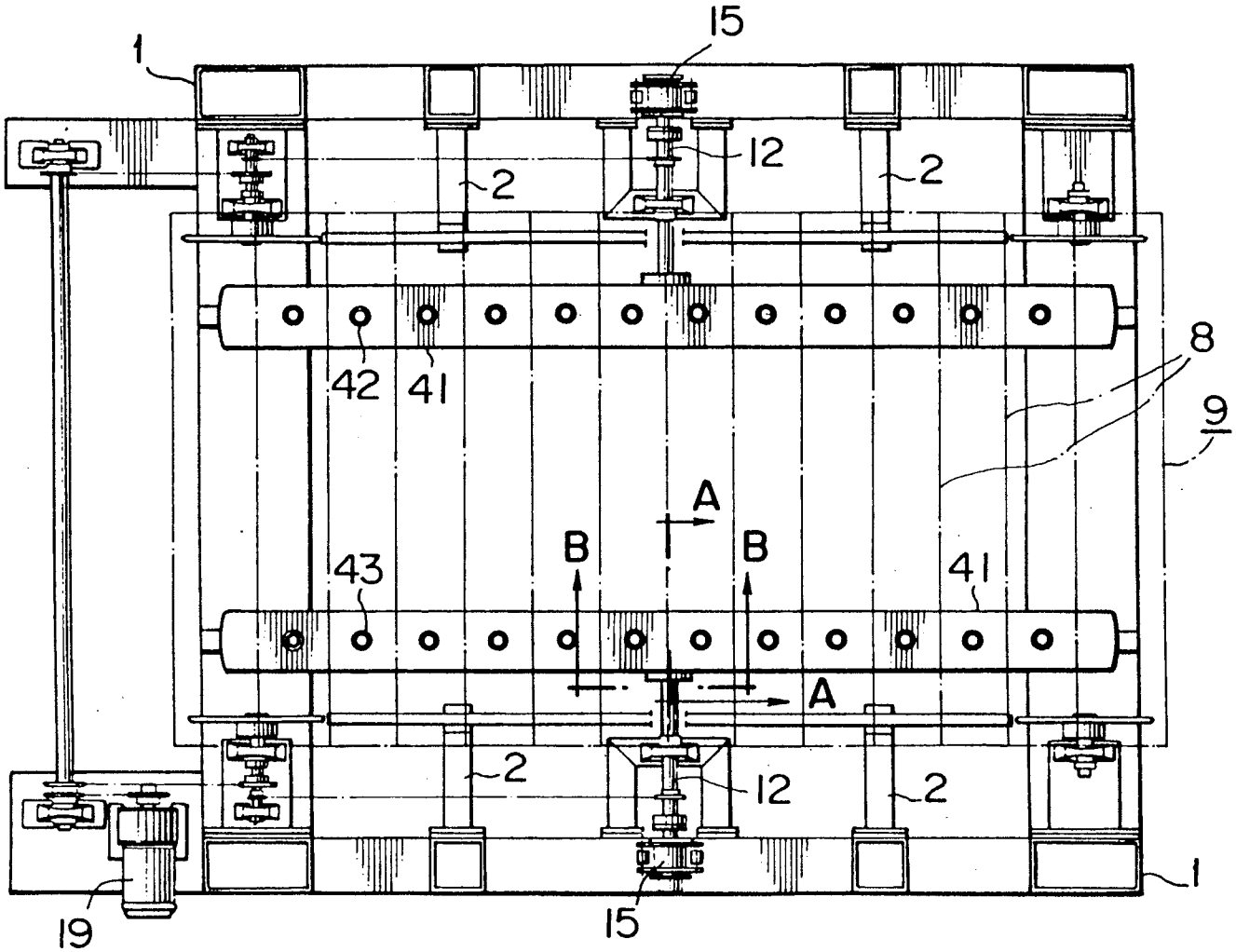
FIG. 17 is a horizontal section of another embodiment of the present invention in which a pair of headers are used in a caterpillar to supply and discharge a heat transfer medium.
Figure 18:
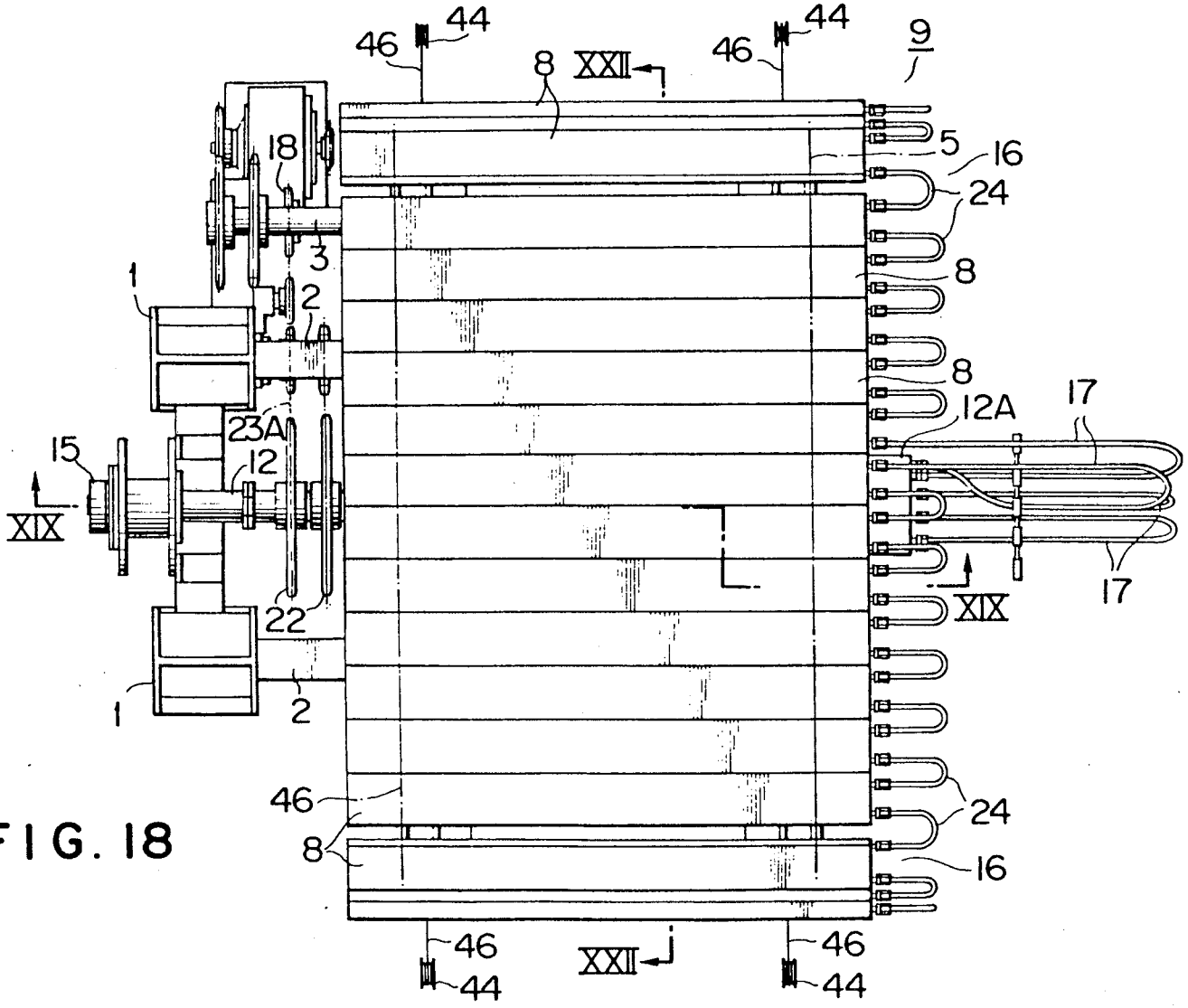
FIG. 18 is a plan view of another embodiment of the invention in which carrying in and out of a plate to be treated are facilitated.
Figure 19:
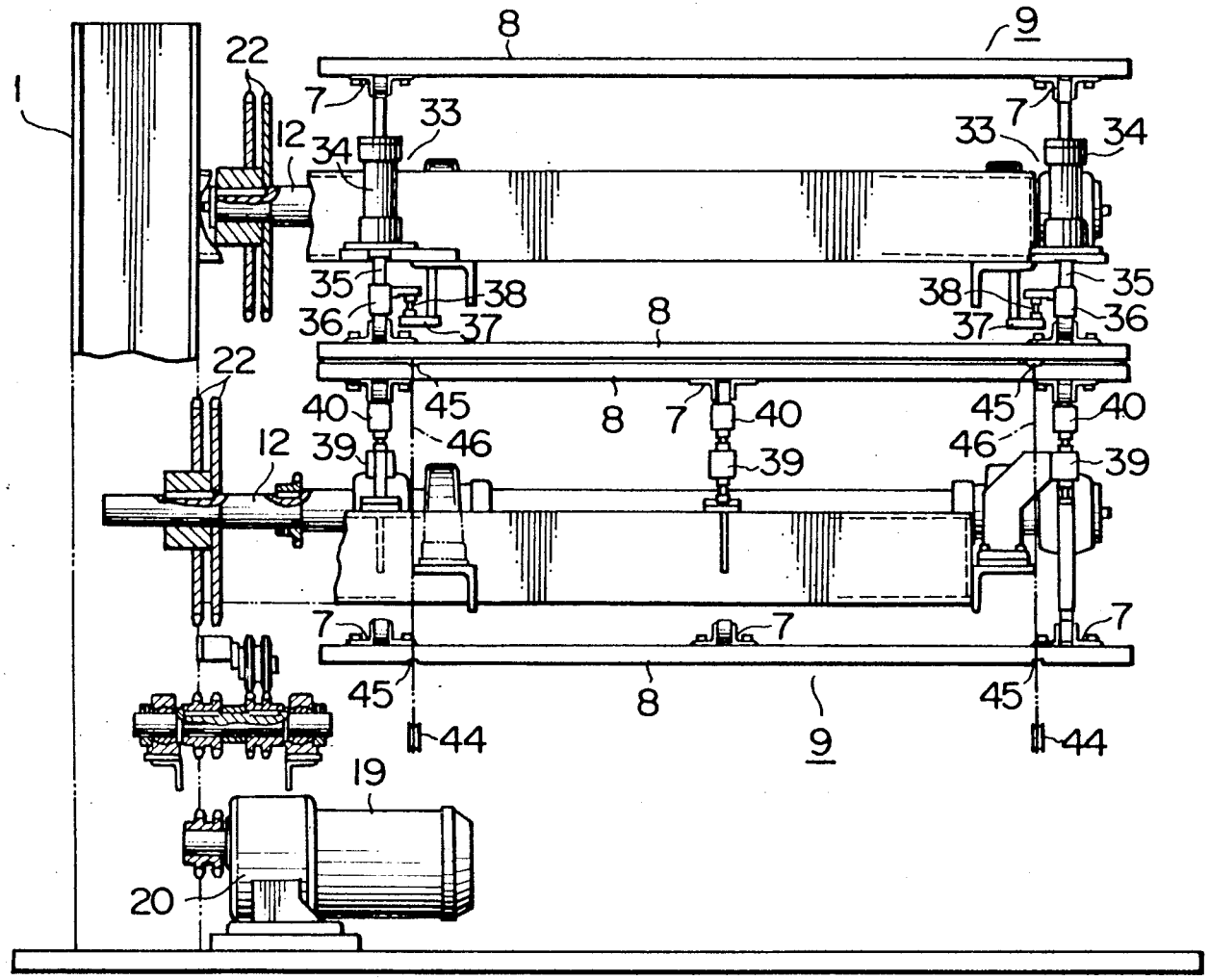
FIG. 19 is an enlarged view partly taken away and taken along the line XIX—XIX in FIG. 18.

FIG. 17 illustrates another embodiment in which a pair of headers 41 and 41 are provided to supply and discharge a heat transfer medium. The headers 41 and 41 are made of a resilient material such as rubber and are capable of bending at the turning portions 16 and 16 of a caterpillar 9 as the caterpillar 9 turns. More specifically, each of the hot plates 8 is provided at its inner surface with an inlet 42 and outlet 43 of the heat transfer medium passage. The headers 41 and 41 are disposed in parallel with each other along the traveling direction of each caterpillar 9. One of the headers 41 and 41 serves to supply a heat transfer medium and the other to discharge the heat transfer medium. Each of the headers 41 and 41 is longitudinally provided at its outer surface with supply ports or discharge ports which are connected to corresponding inlets 42 or outlets 43 of hot plates 8 through joints (not shown). Both the number of the joints to connect the inlets 42 of hot plates 8 to the supply ports of the one header 41 and the number of the joints to connect outlets 43 to the discharge ports are 32 when the number of the hot plates 8 is 32.

Rotary joints 15 and 15 which supply and discharge the heat transfer medium are arranged in the vicinity of respective vertical frames 1 and 1 opposingly erected. A rotary shaft 12 is rotatably supported at its proximal end to each of the rotary joints 15 and 15 and is connected at its distal end to the corresponding header 41 through a conventional joint such as a flange.

The flexible headers 41 and 41 is capable of deforming in the shape of the track of the caterpillar 9, and hence they follow the turning of the caterpillar 9 with a gap equal to the length of the joints which interconnect the caterpillar 9 and the headers 41. Also in this embodiment, the headers 41 and 41 are expanded at the turning portions of the caterpillar 9 as gaps between adjacent hot plates 8 become larger.

FIGS. 18 to 22 show an embodiment in which plates 25 to be treated are smoothly carried in and out of plate treating apparatus above described.

Figure 20:
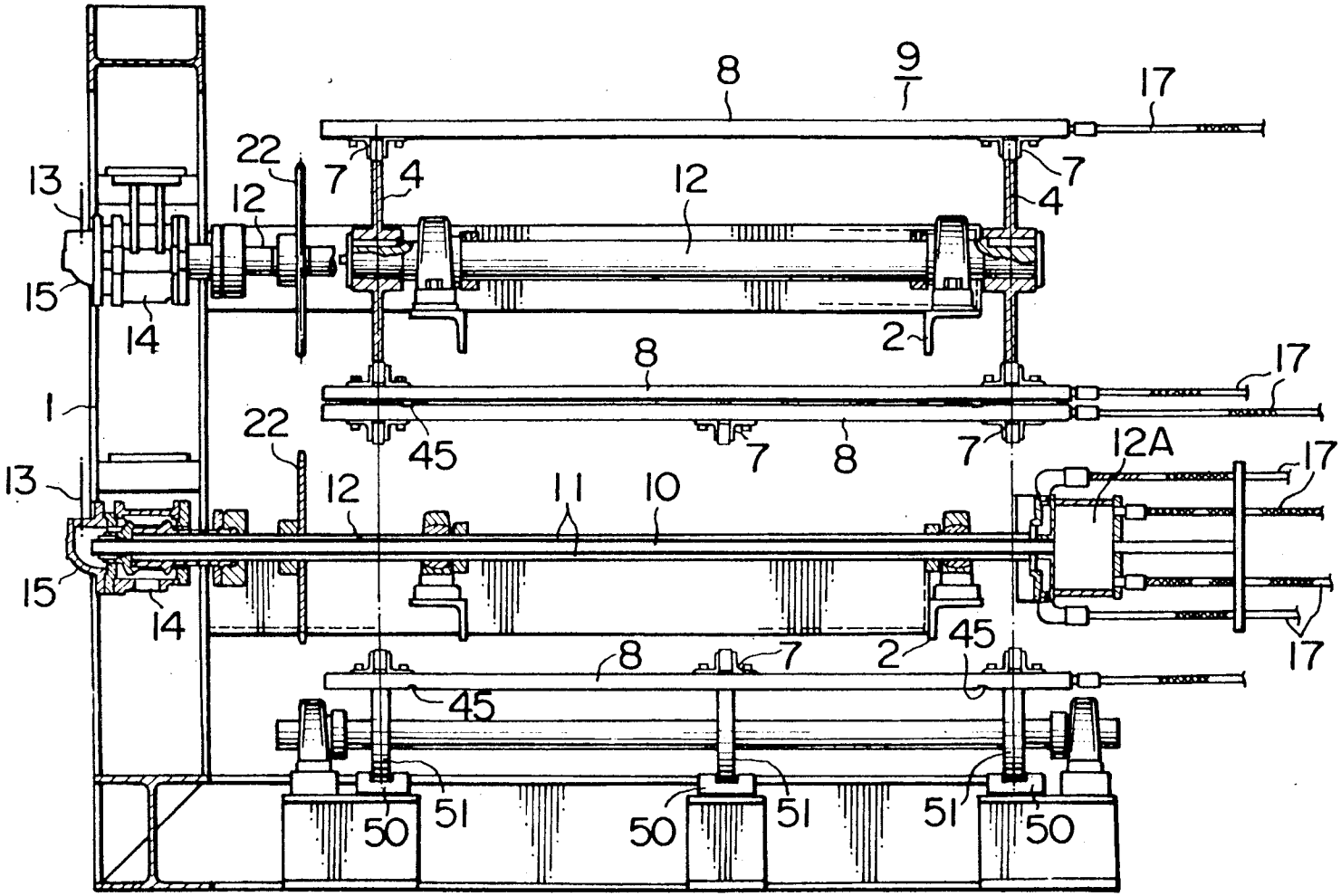
FIG. 20 is another enlarged view partly taken away and taken along the line IXX—IXX in FIG. 18.
Figure 21:
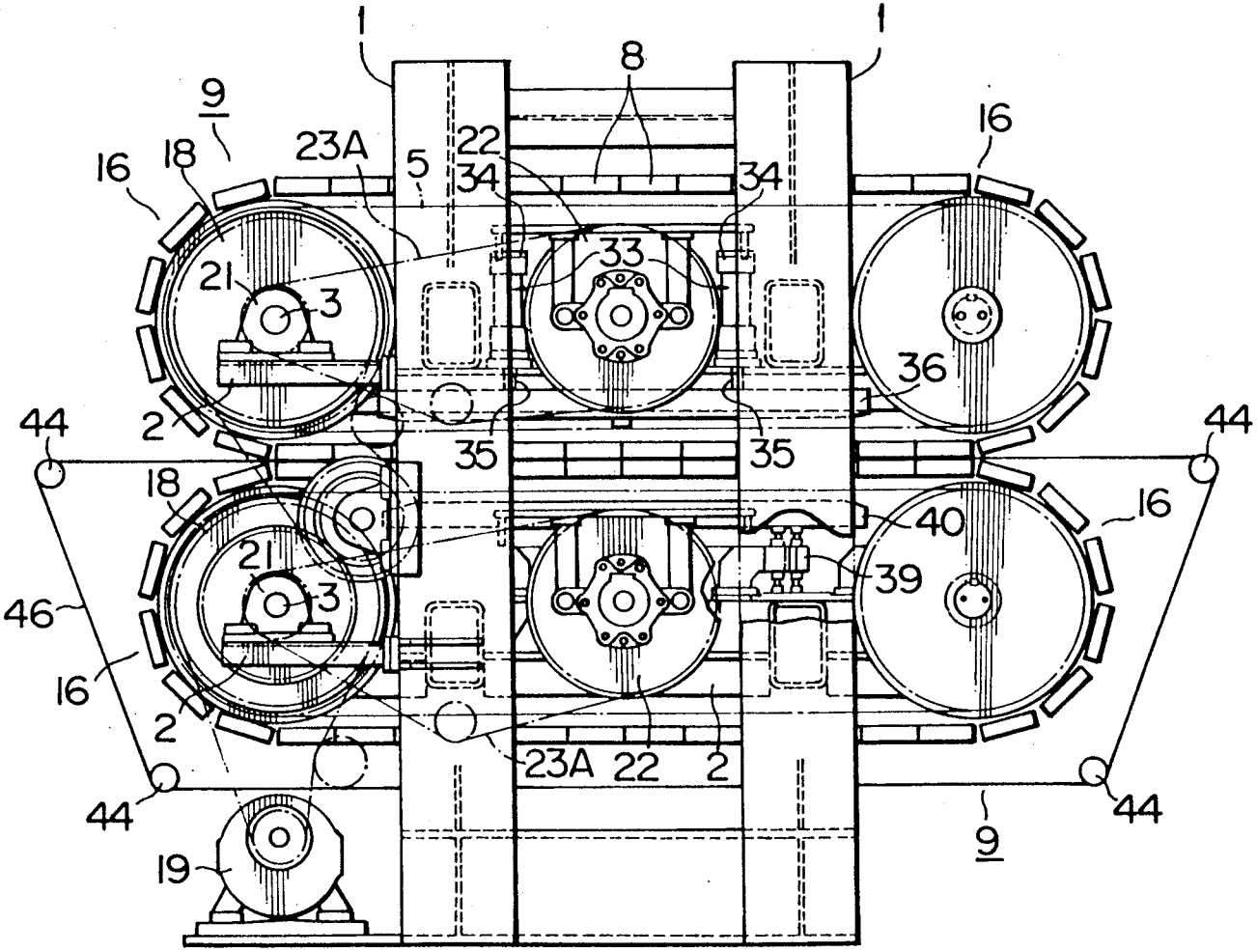
FIG. 21 is a left-hand side view of the plate treating apparatus of FIG. 18.
Figure 22:
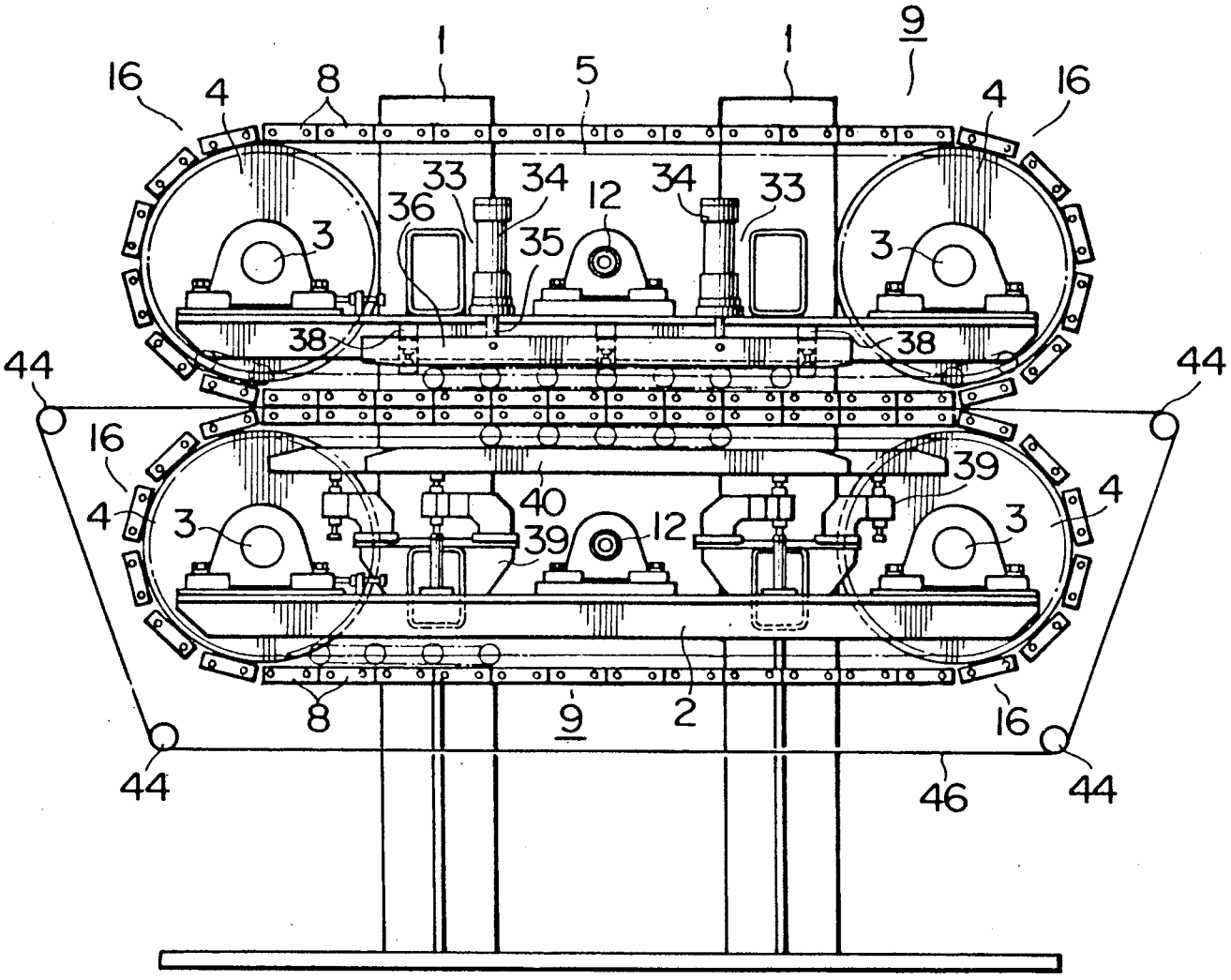
FIG. 22 is a view taken along the line XXII—XXII in FIG. 18.

A pair of V-shaped or U-shaped grooves 45 and 45 are, as shown in FIG. 20, formed in an outer surface of each hot plate 8 with a longitudinal interval and in parallel with the conveying direction. Two sets of four pulleys 44, 44, 44 and 44 are arranged close to the veneer-carrying-in position and carrying-out position of the lower caterpillar 9, the two sets being disposed in a transversely spaced manner. An endless guiding belt 46, such as a wire, a piano wire and a chain, extends around each set of the pulleys 44, 44, 44 and 44 and fits into a corresponding groove 45.

Figure 23:
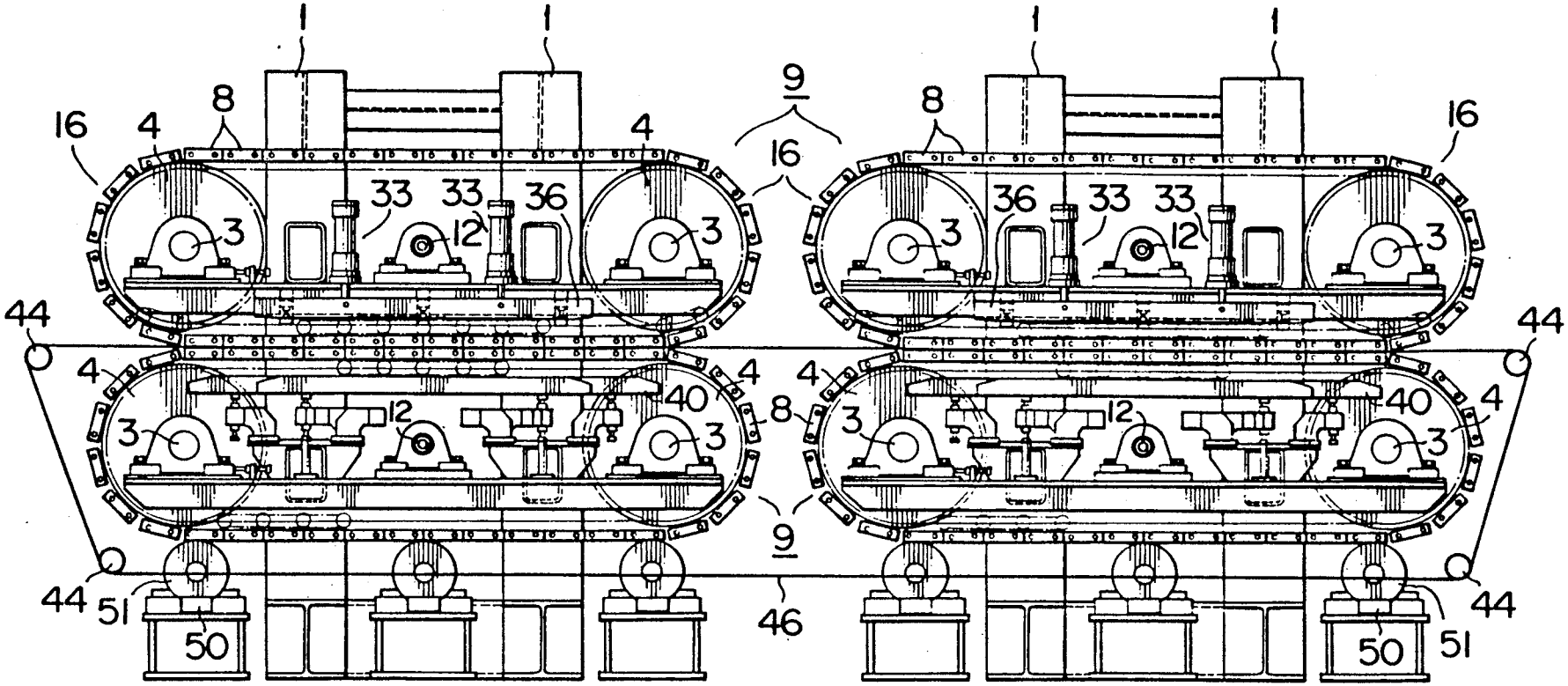
FIG. 23 is a side view of a modified form of the plate treating apparatus of FIG. 18 in which two plate treating apparatuses are arranged in series.

When a plurality of (two in the embodiment of FIG. 23) plate treating apparatuses are closely installed in series, the caterpillars 9 are arranged sot hat corresponding grooves 45 of end-to-end facing caterpillars 9 of adjacent plate treating apparatuses are aligned. Several sets of pulleys 44, 44, 44 and 44 are arranged int he vicinity of the plate-carrying-in and -out positions of the combined plate treating apparatuses as shown in FIG. 23, and a gilding belt 46 extends around each set of pulleys 44, 44, 44 and 44 to fit in corresponding grooves 45 of the plate treating apparatuses. This embodiment facilitates the carrying in and out of the plate 25 to be treated and transfer of the plate 25 between two plate treating apparatuses.

Figure 24:
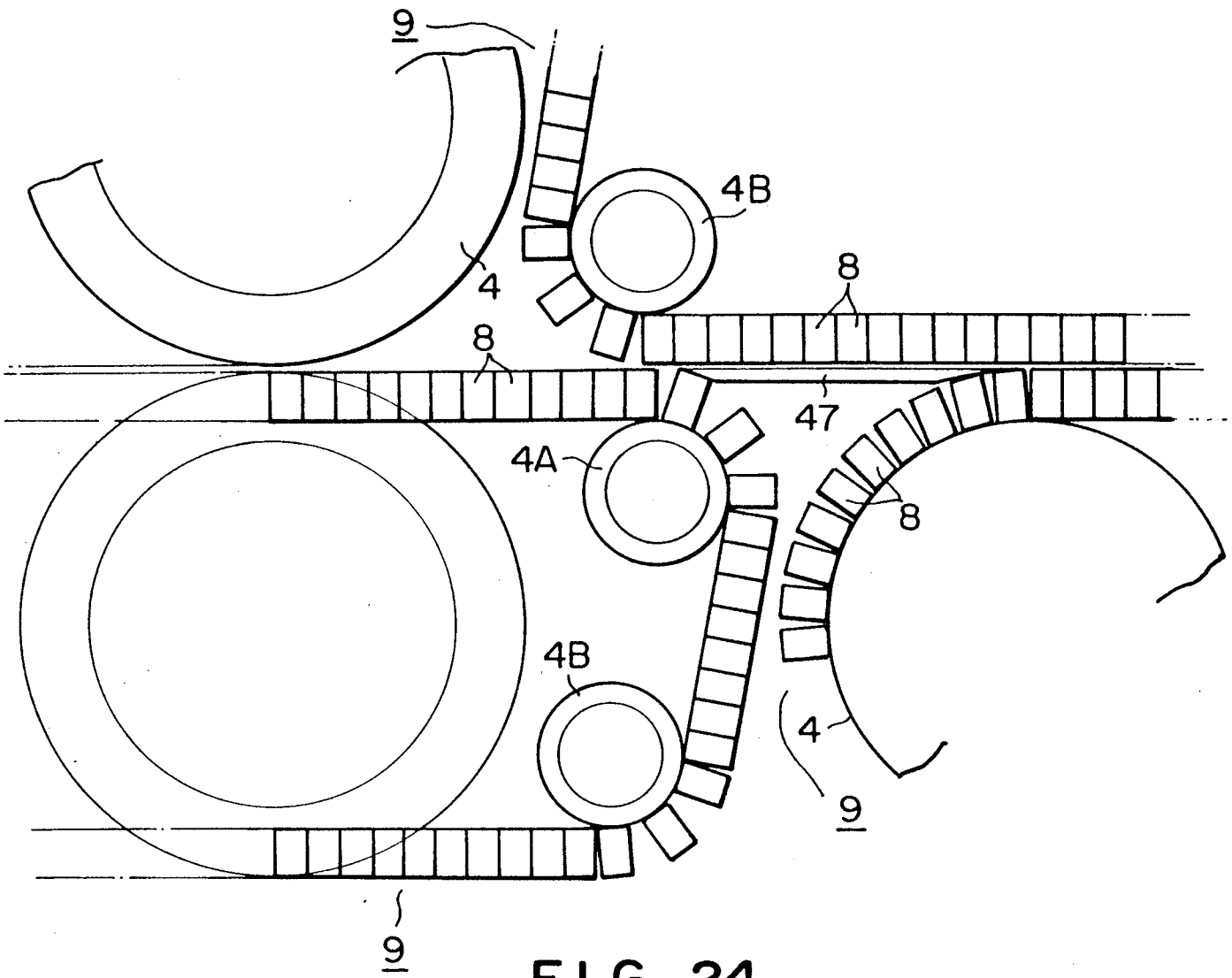
FIG. 24 is an enlarged partial side view of a modified form of two combined plate treating apparatuses of FIG. 18.

Another embodiment in which plate treating apparatuses are arranged in series without guide belts 46 above described is illustrated in FIG. 24. The hot plates 8 of this embodiment are made smaller in width than those of the preceding embodiments. A lower caterpillar 9 of one of adjacent plate treating apparatuses is arranged to project at its one end, for example, a trailing end from one end (trailing end) of the upper caterpillar 9 of the same plate trailing apparatus. As shown in FIG. 24, an upper sprocket wheel 4A of the trailing end of the lower caterpillar 9 of the left-hand plate treating apparatus is projected from the trailing end of the upper caterpillar 9 of the same plate treating apparatus. On the other hand, a leading end of an upper caterpillar 9 of an adjacent or right hand plate treating apparatus is located to project from the leading end of the lower caterpillar 9 of the same plate treating apparatus. Thus in the right-hand plate treating apparatus, a lower sprocket wheel 4B of the leading end of the upper caterpillar 9 is located to project from the leading end of the lower caterpillar 9. The plate treating apparatuses are arranged in such a manner that the projected leading end of the upper caterpillar 9 of the left-hand plate treating apparatus overlaps the projected trailing end of the lower caterpillar of the right-hand plate treating apparatus. In this embodiment, a guide plate member 47 is provided between the projected end of the lower caterpillar 9 of the left-hand plate treating apparatus and the retreated end of the lower caterpillar 9 of the right-hand plate treating apparatus for guiding a plate to be treated.

Figure 25:
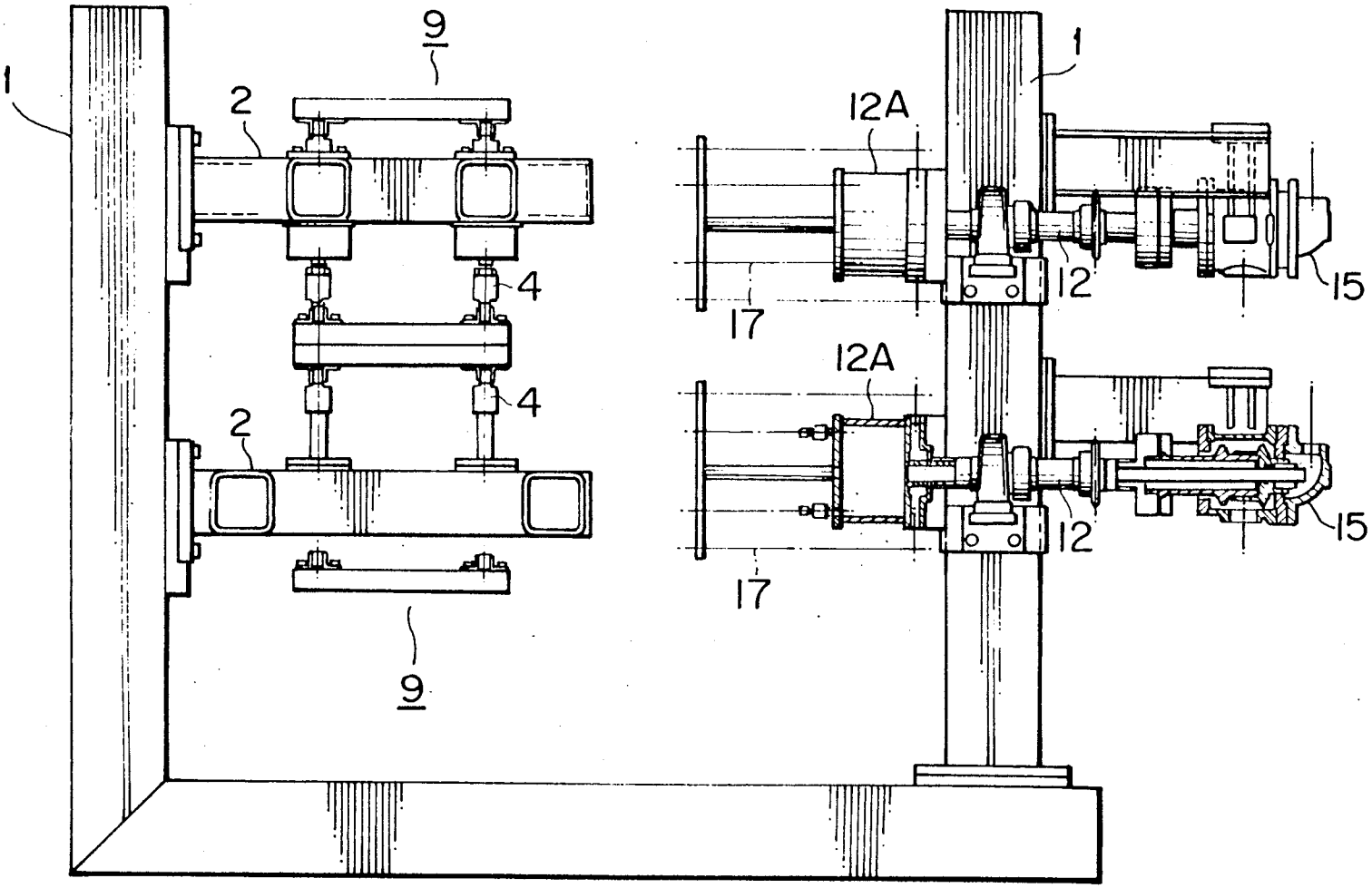
FIG. 25 is a front view in section of a modified form of the plate treating apparatus of FIG. 4.

FIG. 25 illustrates another embodiment in which a heat transfer medium circulating system is provided outside the caterpillars 9 and 9. Sprocket wheels 4 of the caterpillars 9 and 9 are rotatably supported on beams 2 and 2 horizontally projected from one of two vertical frames 1 and 1. The other frame 1 rotatably supports horizontal rotary shafts 12 and 12 of which heat transfer medium supplying portions 10 and heat transfer medium discharging portions 11 are connected to connecting tubes 17. The connecting tubes 17 are connected to hot plates 8 of the caterpillars 9 and 9. Also in this embodiment, the caterpillars 9 and 9 and the rotary shafts 12 and 12 are synchronously turned to swing connecting tubes 17 like jumping ropes to supply and discharge the heat transfer medium.

Figure 26:
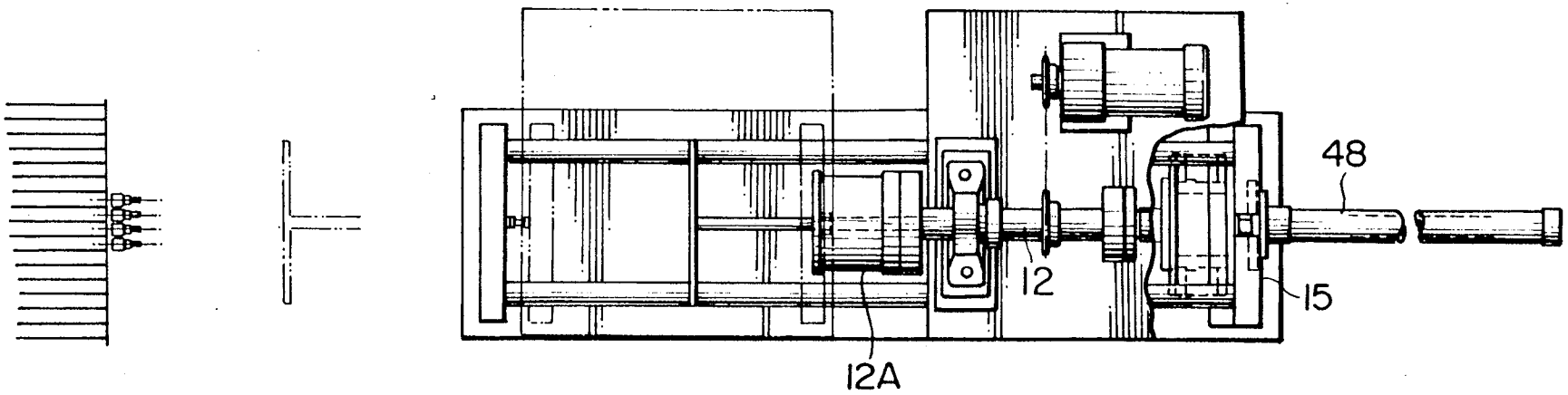
FIG. 26 is a plan view of a reciprocating mechanism for reciprocating headers of FIG. 25 to facilitate the actuation of the heat transfer medium circulating system.
Figure 27:
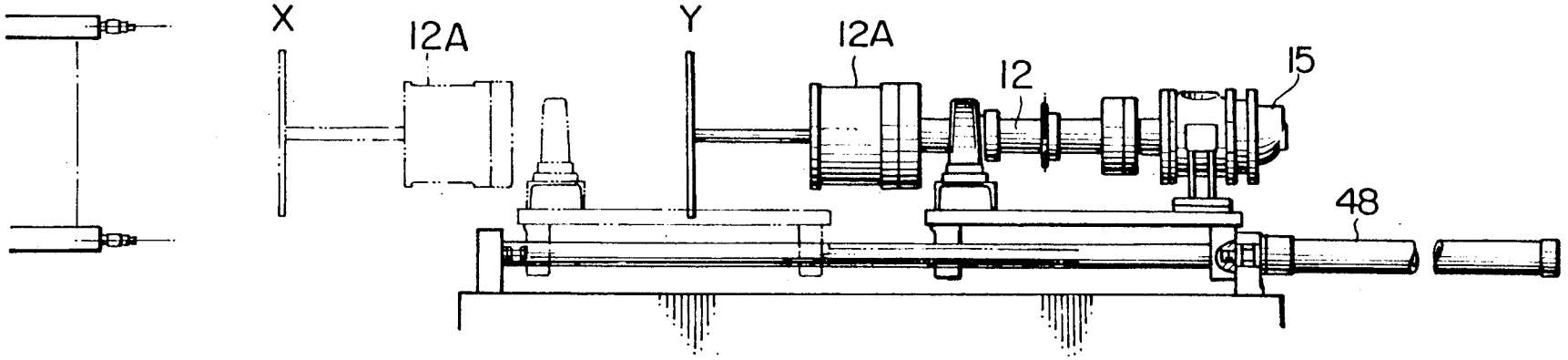
FIG. 27 is a side view of the reciprocating mechanism of FIG. 26.

As shown in FIGS. 26 and 27, the heat transfer medium supplying and discharging header 12A of each rotary shaft 12 is capable of reciprocating between a projection limit X and retreat limit Y by fluid cylinders 48 or like members in such a manner that the heat transfer medium supplying portion 10 and heat transfer medium discharging portion 11 make one reciprocating movement for one turn of the corresponding caterpillar to keep the connecting tubes 17 from being excessively slackened.

FIGS. 28 to 34 illustrate embodiments which enhances the capacity of connecting tubes 17 to follow the shape of the caterpillars 9 and 9. The connecting tubes 17 connect hot plates 8 of the caterpillars 9 and 9 and rotary shafts 12.

Figure 28:
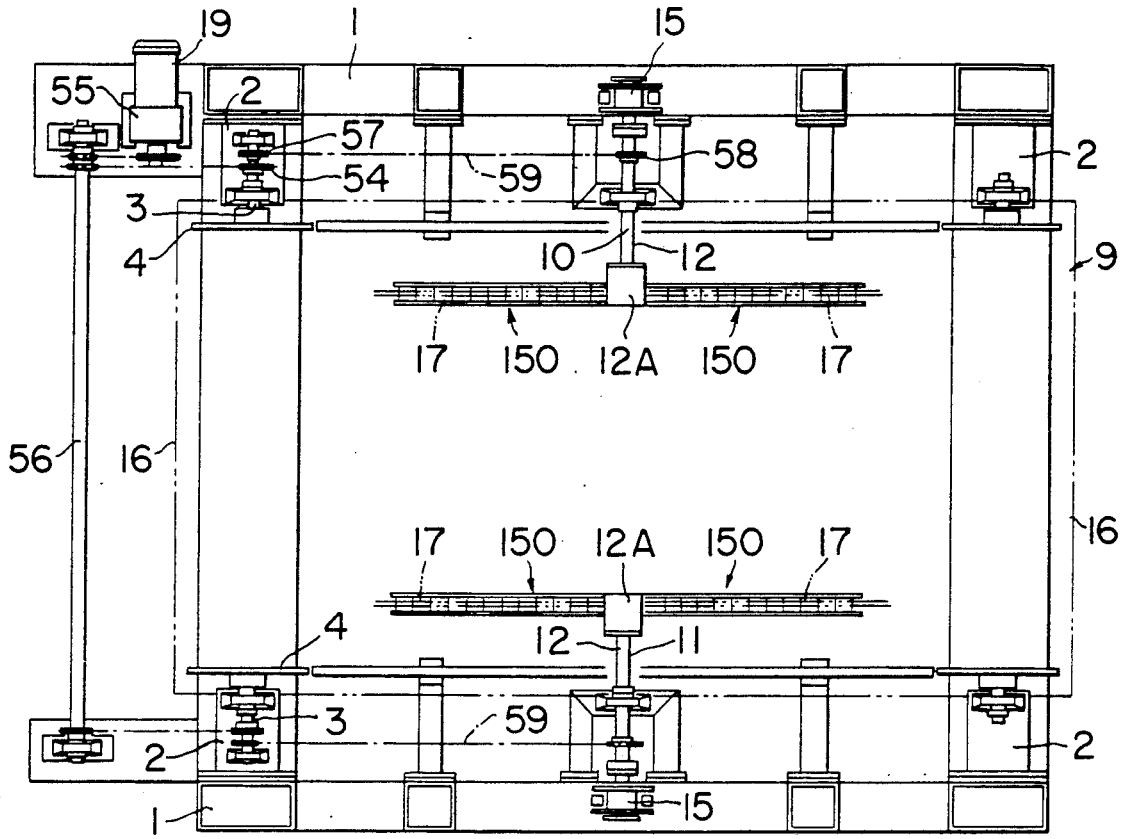
FIG. 28 is a plan view, partly taken away, of another embodiment of the present invention.
Figure 29:
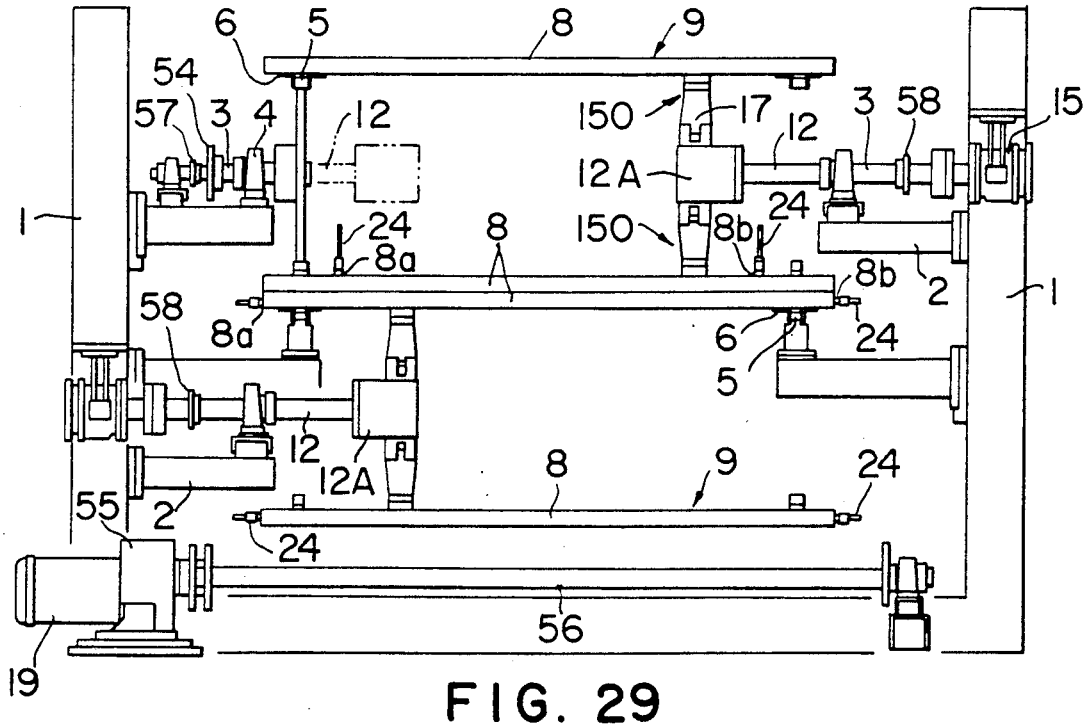
FIG. 29 is an enlarged front view of the plate treating apparatus of FIG. 28.
Figure 30:
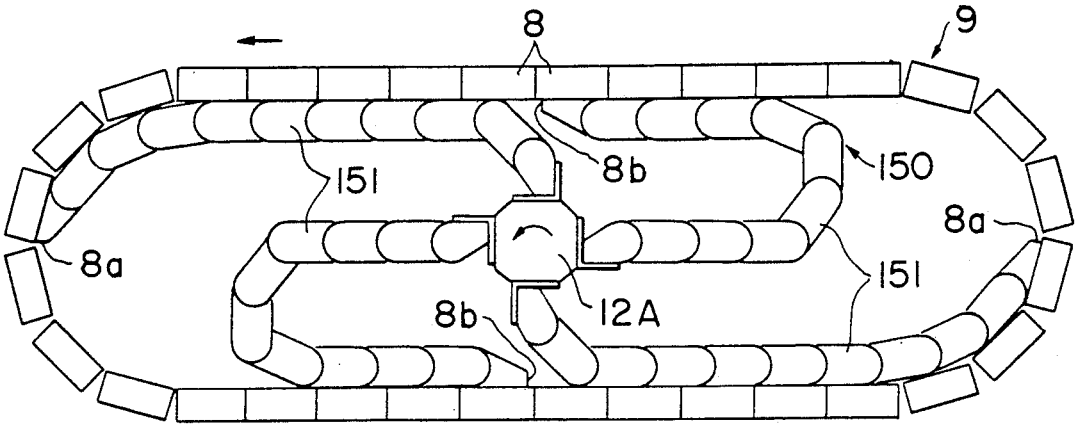
FIG. 30 is an illustration of a modified form of the caterpillar of FIG. 28 in which connecting tubes are coated with flexible cable bears.
Figure 31:
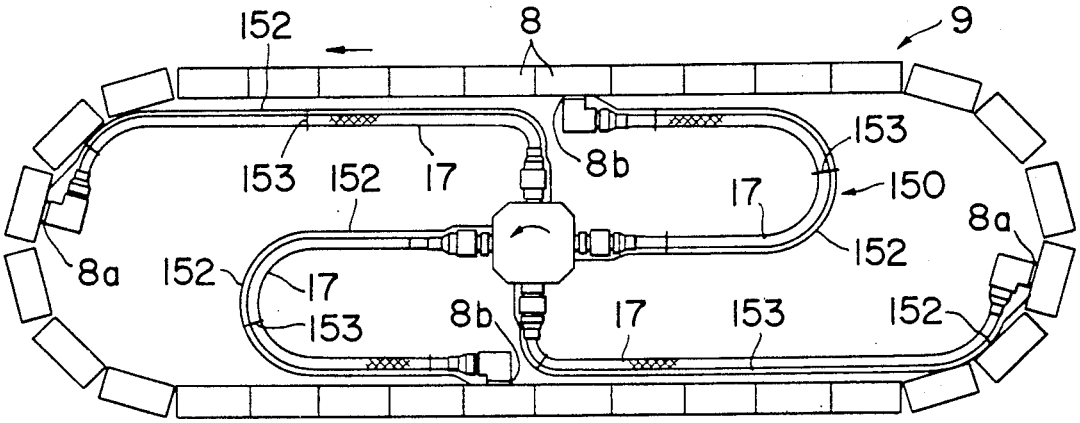
FIG. 31 is an illustration of another modified form of the caterpillar of FIG. 28 in which steel belts are placed along connecting tubes.

In FIGS. 28 and 29, two pairs of sprocket wheels 4 and 4 of each caterpillar 9 are supported on respective vertical frames 1 and 1 erected along opposite sides of the caterpillars 9 and 9. The supporting structure of the caterpillars 9 and 9 and their related structure are the same as those of FIGS. 10 to 13, and hence corresponding parts are designated by like reference numerals and descriptions thereof are omitted. In this embodiment, a flexible member 150 is attached at its opposite ends to each connecting tube 17 in the vicinity of respective ends for protecting the connecting tube 17. The flexible member 150 is deformable according to the curvature of the turning portions 16 and 16. The resiliency and flexibility of the flexible members 150 enables that one revolution of the rotary shafts 12 is synchronized with one turn of respective caterpillars 9. Cable bears 151 which are bendable in the shape of jointed limbs as shown in FIG. 30 or steel belts 152 as in FIG. 31 are suitably used as the flexible members 150. Both connecting tubes 17 and flexible members 150 are resilient and hence bend to follow the curvature of the inner circumference of the caterpillar 9 every time when they reach the turning portions 16. Although each connecting tubes 17 and the corresponding flexible belt 150 cannot be separated from each other, they may be, as shown in FIG. 31, bound with binding members such as a wire at an appropriate interval for positively preventing separation.

The connection of the header 12A of the rotary shaft 12 and hot plates 8 through connecting tubes 17 as shown in FIGS. 30 to 33 is effective for turning the rotary shaft 12 together with the caterpillar 9.

As shown in FIGS. 28 and 29, a sprocket wheel 54 is mounted around one of the supporting shafts 3 and 3 of each pair and is rotated by an electric motor 19 through a speed reducer 55 and a chain (not shown). Each caterpillar 9 is provided with a hollow inside, and hence this embodiment adopts a caterpillar driving system in which supporting shafts 3 and 3 of each pair are independently rotated. The other supporting shaft 3 of the same pair is rotated synchronously with the one supporting shaft 3 by the motor 19 through the speed reducer 55 and a chain transmission including a synchronizing shaft 56. The synchronizing shaft 56 transversely extends below the lower caterpillar 9.

Figure 32:
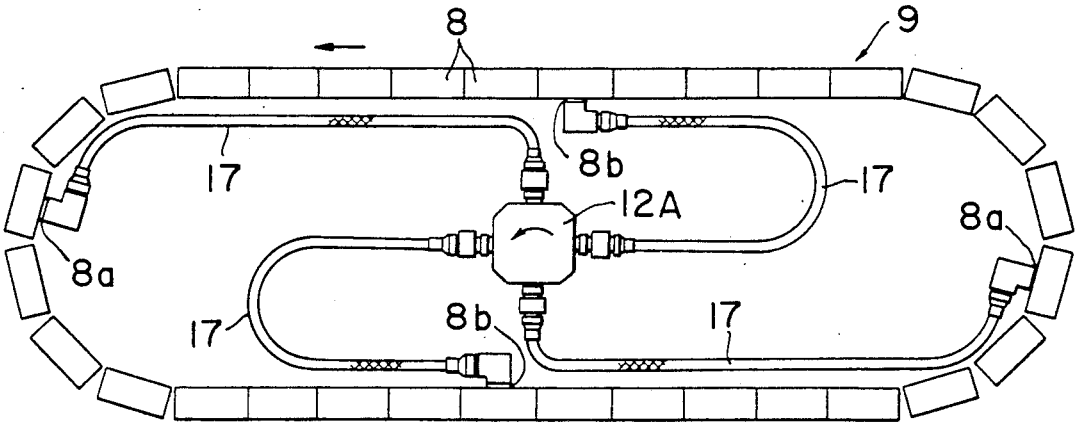
FIG. 32 is an illustration of another modified form of the caterpillar of FIG. 28 in which connecting tubes are used without any cable bear or steel belt.
Figure 33:
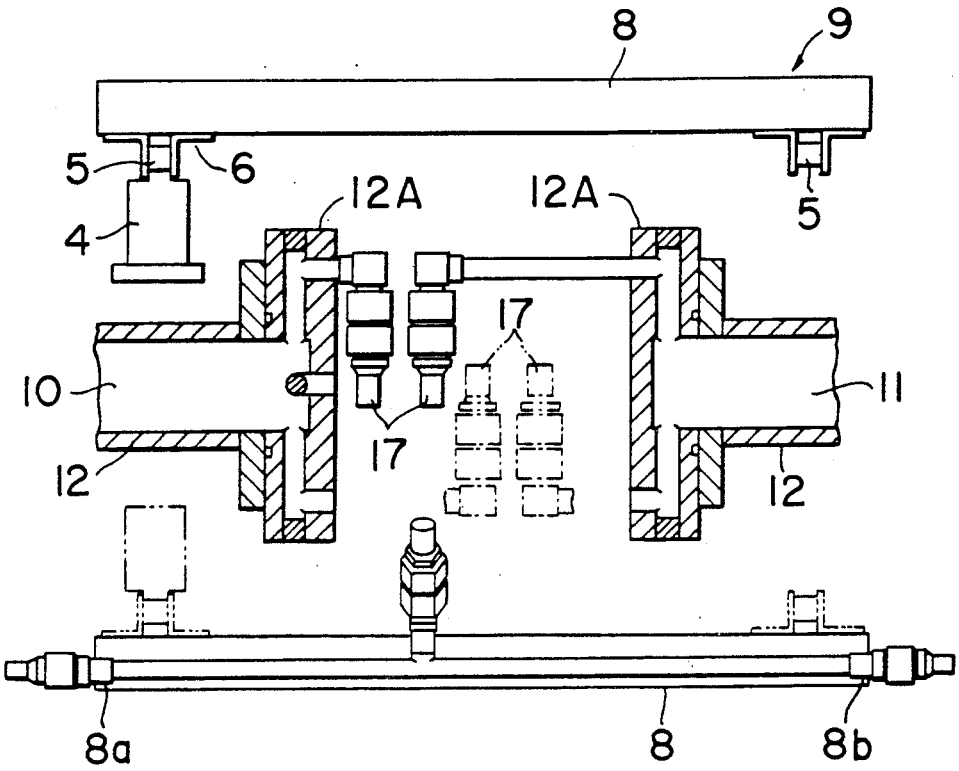
FIG. 33 is a fragmentary view in section of the caterpillar of FIG. 32, illustrating how to join connecting tubes and rotary shafts.

When each of the caterpillars 9 and 9 is turned, the rotary shaft 12 can be synchronously rotated only by the pulling force of the connecting tubes 17 as shown in FIG. 32 since the connecting tubes 17 have rigidity to some extent. Alternatively, a sprocket wheel 57 having teeth different in number from the teeth of the sprocket wheel 54 may be mounted around the same shaft 3, and the sprocket wheel 57 may be connected to a sprocket wheel 58 mounted on the rotary shaft 12 through a chain 59. With this arrangement, the rotary shaft 12 is synchronously controlled in a mechanical manner to make a revolution for a turn of the caterpillar 9. Instead of the mechanical control, an electrical synchronizing control may be adopted in which pulse generators are provided to shafts 3 and rotary shafts 12 of each caterpillar 9.

In FIGS. 30 and 31, the caterpillars 9 and the rotary shafts 12 thereof are as previously described synchronized by the flexible members 150 and hence the mechanical or electrical synchronization is not necessary.

Also in the embodiments of FIGS. 28 to 32, supplying and discharging of a heat transfer medium are carried out for each group of hot plates 8. Each caterpillar 9 of the embodiments includes two groups of adjacent hot plates 8, each group containing 16 hot plates 8. An inlet **8*a* of a leading hot plate 8 of each group is connected to a heat transfer medium supplying portion 10 of the rotary shaft 12 through a connecting tube 17 which extends along the inner faces of the hot plates 8 in a plane perpendicular to the rotary shaft 12. As shown in the upper caterpillar 9 of FIG. 29, each of the hot plates 8 is provided in its inner surface with an inlet 8*a* and an outlet 8*b*. The inlet 8*a* of one of the hot plates 8 is connected to the outlet 8*b* of the adjacent hot plate 8 of the same group through a connecting joint 24. On the other hand, in the lower caterpillar 9 of FIG. 29, each hot plate 8 is provided at its opposite ends with an inlet 8*a* and an outlet 8*b*, and the inlet 8*a* of one end of a hot plate 8 is connected to the outlet 8*b* of one end of the adjacent hot plate 8 of the same group. The outlet 8*b* of a hot plate 8, from which the heat transfer medium of the group of the hot plates 8 are discharged, is connected to a discharging part of the rotary shaft 12 through another connecting tube 17, which extends perpendicularly to the rotary shaft 12 and partly along the inner surfaces of some hot plates 8. With such an arrangement, only two connecting tubes 17 are needed for each group of hot plates 8, and hence the diameter of the header 12A of the rotary shaft 12 is reduced. In the plate treating apparatus of FIGS. 28 and 29 a pair of connecting tubes 17 project from each header 12A with a angular interval 180° about an axis of the header 12A**.

When only connecting tubes 17 are used or when connecting tubes 17 are combined with flexible members 150, as in FIGS. 28 to 31, the rotary shafts 12 are pulled by those members while rotated, and hence the rotary shafts 12 follows the rotation of the caterpillar 9 wIth a time lag.

Figure 34:
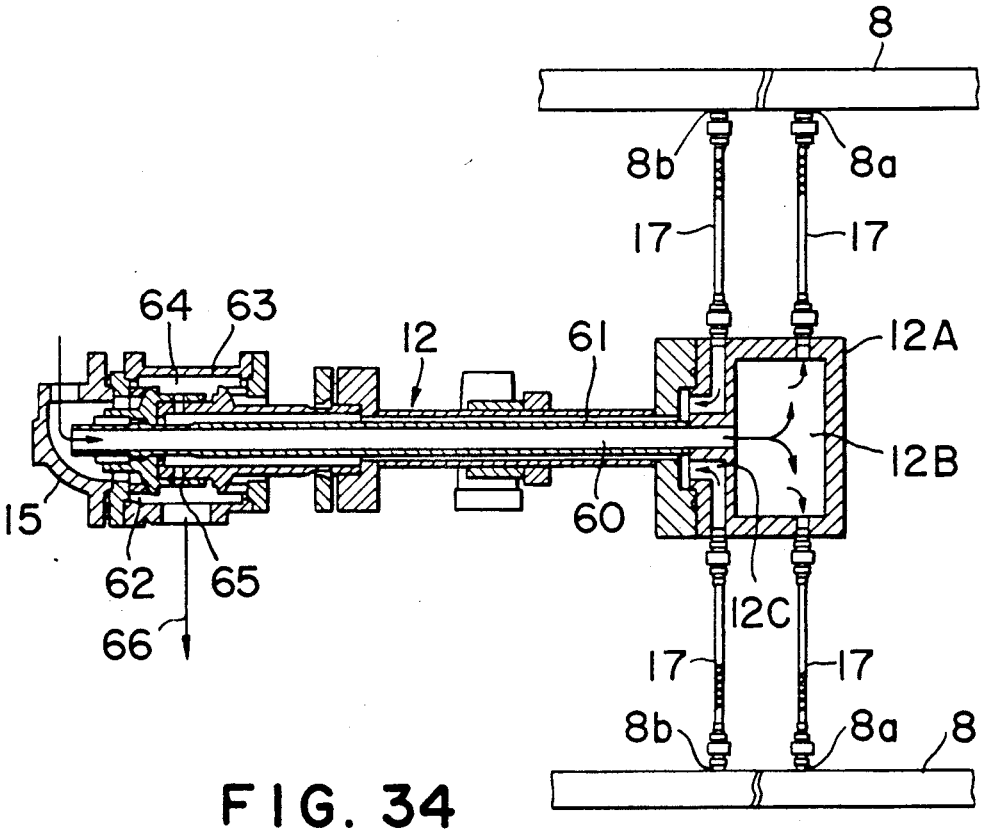
FIG. 34 is an enlarged partial view in section of the caterpillar of FIG. 32, illustrating a rotary shaft provided only on one side of the caterpillar for supplying and discharging a heat transfer medium.

FIG. 34 illustrate a heat transfer medium circulating system for a caterpillar 9 which is supported on a frame in a cantilever fashion. In the system, a pipe 60 is inserted into a hollow rotary shaft 12 and is communicated at one end to a supplying chamber 12B of a header 12A and at the other end to a rotary joint 15. A discharging passage 61 is defined between the rotary shaft 12 and the pipe 60. The discharging passage 61 is communicated at one end to a discharging chamber 12C of the header 12A and the other end thereof is closed with a sealing member 62. An outer shell member 63 surrounds around the other end of the rotary shaft 12 to define a discharging chamber 64. The discharging passage 61 communicates to the discharging chamber 64 through a communication hole 65 formed through the rotary shaft 12. The discharging chamber 64 is connected to a drain or a recirculating system through a conduit 66.

In the plate treating apparatus of FIG. 34, connecting tubes 17 are connected to the header 12A perpendicularly to the axis of the rotary shaft 12. This arrangement produces little torsional stress in the connecting tubes 17 and provides excellent synchronization of the rotary shaft 12 with the caterpillar 9. Thus, it is possible to make the circumferential length of the caterpillar 9 fairly long. The rotary shaft 12 is rotated by the pulling force of the connecting tubes 17 plus the physical synchronization control.

In the present invention, as the heat transfer medium use may be made of steam, hot oil, warm water or a like medium for heating a plate to be treated. A cooling gas, cold water, or a like medium may be according to the present invention used as the cooling medium.

According to the present invention, various kinds of plate like materials, such as a veneer, chip board, fiber board, resin laminated board, plywood and a like material may be heat dried, hot pressed, or cooled.

What is claimed is:

1. A method of circulating a heat transfer medium through a caterpillar, comprising the steps of:

arranging a heat transfer medium supplying rotary shaft within one side of the caterpillar in a transverse direction and a heat transfer medium discharging rotary shaft within the other side in alignment with the heat transfer medium supplying rotary shaft, the caterpillar including a group of strip-shaped hot plates disposed closely in parallel to each other, the caterpillar including opposite turning portions, each hot plate having a heat transfer medium passage formed therein, each heat transfer medium passage having an inlet and an outlet;

supporting proximal portions of both the heat transfer medium supplying rotary shaft and the heat transfer medium discharging rotary shaft on respective rotary joints;

sending the heat transfer medium through connecting tubes from the supplying rotary shaft to the inlets of the heat transfer medium passages and then from the outlets of the heat transfer medium passages to the discharging rotary shaft, the connecting tubes being-long enough to reach the turning portions of the caterpillar;

synchronously controlling the rotary shafts and the caterpillar in such a manner that each rotary shaft makes a revolution for a turn of the caterpillar.

2. A method of circulating a heat transfer medium through a caterpillar, comprising the steps of:

arranging a rotary shaft, having a proximal portion, on one side of the caterpillar, the rotary shaft being supported at the proximal portion thereof on a rotary joint, the caterpillar including a group of strip-shaped hot plates closely disposed in parallel to each other, the caterpillar including opposite turning portions, each hot plates having a heat transfer medium passage formed therein, each heat transfer medium passage having an inlet and an outlet, the rotary shaft having a heat transfer medium supplying portion and a heat transfer medium discharging portion separately formed therein;

sending the heat transfer medium through connecting tubes from the supplying portion of the rotary shaft to the inlets of the heat transfer medium passages and then from the outlets of the heat transfer medium passages to the discharging portion of the rotary shaft, the connecting tubes being long enough to reach the returning portions of the caterpillar;

synchronously controlling the rotary shaft and the caterpillar in such a manner that the rotary shaft makes a revolution for a turn of the caterpillar.

3. A method of circulating a heat transfer medium through a caterpillar, comprising the steps of:

transversely arranging a rotary shaft, having a proximal portion, within the caterpillar, the rotary shaft being rotatably supported at the proximal portion thereof on a rotary joint, the caterpillar including a group of strip-shaped hot plates closely disposed in parallel with each other and including a leading heat hot plate and a trailing hot plate, the caterpillar including opposite turning portions, each hot plates having a heat transfer medium passage formed therein, each heat transfer medium passage having an inlet and an outlet, the rotary shaft having a heat transfer medium supplying portion and a heat transfer medium discharging portion separately formed therein from one end thereof to the other end;

connecting the outlet of each hot plate to the inlet of a following adjacent hot plate by a connecting joint to thereby communicate the heat transfer medium passages of the adjacent two hot plates in series;

sending the heat transfer medium through a connecting tube from the supplying portion of the rotary shaft to the inlet of the leading hot plate and then through another connecting tube from the outlet of the trailing hot plate to the discharging portion of the rotary shaft, the connecting tubes being long enough to reach the returning portions of the caterpillar;

synchronously controlling-the rotary shaft and the caterpillar in such a manner that the rotary shaft makes one revolution for a turn of the caterpillar.

4. A method of circulating a heat transfer medium through a caterpillar, comprising the steps of:

transversely arranging a heat transfer medium supplying rotary shaft within one side of the caterpillar and a heat transfer medium discharging rotary shaft within the other side in alignment with the heat transfer medium supplying rotary shaft, the caterpillar including a group of strip-shaped hot plates closely disposed in parallel with each other and including a leading hot plate and a trailing hot plate, the caterpillar including opposite turning portions, each hot plate having a heat transfer medium passage formed therein, each heat transfer medium passage having an inlet and an outlet;

supporting both the heat transfer medium supplying rotary shaft and the heat transfer medium discharging rotary shaft at proximal portions thereof on respective rotary joints;

connecting the outlet of each hot plate to the inlet of a following adjacent hot plate by a connecting point to thereby communicate the heat transfer medium passages in series from the leading hot plate to the trailing hot plate;

sending the heat transfer medium through a connecting tube from the supplying rotary shaft to the inlet of the leading hot plate and then through another connecting tube from the outlet of the trailing hot plate to the discharging rotary shaft, the connecting tubes being long enough to reach the returning portions of the caterpillar;

synchronously controlling the rotary shaft and the caterpillar in such a manner that the rotary shaft makes a revolution for a turn of the caterpillar.

5. A method of circulating a heat transfer medium through a caterpillar, comprising the steps of:

arranging a rotary shaft, having a proximal portion, on one side of and away from the caterpillar, the rotary shaft being supported at the proximal portion thereof on a rotary joint, the caterpillar including a group of strip-shaped hot plates connected closely in parallel to each other and including a leading hot plate and a trailing hot plate, the caterpillar including opposite turning portions, each hot plates having a heat transfer medium passage formed therein, each heat transfer medium passage having an inlet and an outlet, the rotary shaft having a heat transfer medium supplying portion and a heat transfer medium discharging portion separately formed therein from one end thereof to the other end;

connecting the outlet of each hot plate to the inlet of a following adjacent hot plate by a connecting joint to thereby communicate the heat transfer medium passages of adjacent hot plates in series from the leading hot plate to the trailing hot plate;

sending the heat transfer medium through a connecting tube from the supplying portion-to the inlet of the leading hot plate and then through another connecting tube from the outlet of the trailing hot plate to the discharging portion, the connecting tubes being long enough to reach the turning portions of the caterpillar;

synchronously controlling the rotary shaft and the caterpillar in such a manner that the rotary shaft makes a revolution for a turn of the caterpillar.

6. A method of circulating a heat transfer medium through a caterpillar as recited in claim 1, wherein there are provided a pair of the caterpillars arranged one above the other.

7. A method of circulating a heat transfer medium through a caterpillar as recited in claim 1, further comprising a step of depressing an upper extension of the caterpillar by a depressing conveyor.

8. A plate treating apparatus comprising:

a pair of parallel frames each having supporting shafts mounted thereto;

a pair of upper and lower caterpillars arranged in an article conveying direction, the caterpillars being interposed between the frames with the conveying direction parallel with the frames and opposingly arranged one above the other in an opposing manner, each caterpillar including a pair of chain conveyors, extending around the corresponding supporting shafts spaced in the conveying direction, and a group of parallel strip shaped hot plates, closely connected together in an endless manner, the group of the hot plates being mounted to the chain conveyors to surround the chain conveyors, each hot plate having an inner surface, and an inlet and an outlet both formed in the inner surface thereof, the inlet and the outlet being communicated through a heat transfer medium passage formed in the hot plate, the caterpillar including opposite turning portions;

a pair of heat transfer medium supplying rotary shafts arranged one above the other, each supplying rotary shaft having a proximal portion;

supplying rotary shaft connecting tubes, each communicating the supplying rotary shaft to the inlet of each hot plate of a corresponding caterpillar, the connecting tube extendable to the turning portions of the corresponding caterpillar;

a pair of heat transfer medium discharging rotary shafts arranged one above the other, each heat transfer medium discharging rotary shaft being communicated to the outlet of each hot plate of the other caterpillar through another connecting tube extendable to the turning portion of the other caterpillar, and each heat transfer medium discharging rotary shaft being supported through a rotary joint to the other frame;

discharging rotary shaft connecting tubes, each communicating the discharging rotary shaft to the outlet of each hot plate of a corresponding caterpillar, the connecting tube extendable to the turning portions of the corresponding caterpillar;

supporting means for rotatably supporting the heat transfer medium supplying rotary shafts and the heat transfer medium discharging rotary shafts at the proximal portions to respective frames; and synchronous control means for synchronously controlling each rotary shaft and the corresponding caterpillar in such a manner that the rotary shaft makes a revolution for a turn of the caterpillar.

9. A plate treating apparatus comprising:

frame means having supporting shafts mounted thereto;

a pair of upper and lower caterpillars having an article conveying direction, the caterpillars being interposed between the frame means with the conveying direction parallel with the frame means and arranged in an opposing manner, each caterpillar including a pair of chain conveyors, extending around the corresponding supporting shafts spaced in the conveying direction, and a group of parallel strip shaped hot plates, closely connected together in an endless manner, the group of the hot plates including a leading hot plate and a trailing hot plate, the group of the hot plates being mounted to the corresponding chain conveyors to surround the chain conveyors, each hot plate having an inner surface and being provided with an inlet and an outlet both formed in the inner surface thereof, the inlet and the outlet being communicated through a heat transfer medium passage formed in the hot plate, each caterpillar including opposite turning portions;

connecting joints each connecting the outlet of a corresponding hot plate to the inlet of a following adjacent hot plate of the same group;

a pair of heat transfer medium supplying rotary shafts arranged one above the other, each supplying rotary shaft having a proximal portion;

first connecting tubes each communicating a corresponding supply rotary shaft to the inlet of the leading hot plate of a corresponding caterpillar, each first connecting tube extendable to the turning portion of the corresponding caterpillar;

a pair of heat transfer medium discharging rotary shafts arranged one above the other, each discharging rotary shaft having a proximal portion;

second connecting tubes each communicating a corresponding heat transfer medium discharging rotary shaft to the outlet of the trailing hot plate of a corresponding caterpillar, each connecting tube being extendable to the turning portions of the corresponding caterpillar;

supporting means for rotatably supporting the supplying rotary shafts and the discharging rotary shafts at the proximal portions to the frame means; and synchronous control means for synchronously controlling the rotary shaft and the caterpillar in such a manner that the rotary shaft makes a revolution for a turn of the caterpillar.

10. A plate treating apparatus as recited in claim 9, further comprising pressing means for pressing oppositely facing hot plates of the upper and lower caterpillars against each other.

11. A plate treating apparatus comprising:

a pair of parallel frames each having supporting shafts mounted thereto;

a pair of upper and lower caterpillars arranged in an article conveying direction, the caterpillars being interposed between the frames with the conveying direction parallel with the frames and opposingly arranged one above the other in an opposing manner, each caterpillar including a pair of chain conveyors, extending around the corresponding supporting shafts spaced in the conveying direction, and a group of parallel strip shaped hot plates, closely connected together in an endless manner, the group of the hot plates being mounted to the chain conveyors to surround the chain conveyors, each hot plate having an inner surface, and an inlet and an outlet both formed in the inner surface thereof, the inlet and the outlet being communicated through a heat transfer medium passage formed in the hot plate, the caterpillar including opposite turning portions;

a pair of rotary shafts each having a proximal portion, each rotary shaft having a heat transfer medium supplying portion and a heat transfer medium discharging portion separately formed therein from one end thereof to the other end;

first connecting tubes, each communicating the supplying portion of a corresponding rotary shaft to the inlet of each hot plate of a corresponding caterpillar, the first connecting tube extendable to the turning portions of the corresponding caterpillar;

second connecting tubes, each communicating the discharging portion of a corresponding rotary shaft to the outlet of each hot plate of a corresponding caterpillar, the second connecting tube extendable to the turning portions of the corresponding caterpillar;

supporting means for rotatably supporting each rotary shaft at the proximal portion thereof to a corresponding frame; and synchronous control means for synchronously controlling each rotary shaft and the corresponding caterpillar in such a manner that the rotary shaft makes a revolution for a turn of the caterpillar.

12. A plate treating apparatus comprising:

a pair of parallel frames each having supporting shafts mounted thereto;

a pair of upper and lower caterpillars having an article conveying direction, the caterpillars being interposed between the frames with the conveying direction parallel with the frames and arranged in an opposing manner, each caterpillar including a pair of chain conveyors, extending around the corresponding supporting shafts spaced in the conveying direction, and a group of parallel strip shaped hot plates, closely connected together in an endless manner, the group of the hot plates including a leading hot plate and a trailing hot plate, the group of the hot plates being mounted to the corresponding chain conveyors to surround the chain conveyors, each hot plate having an inner surface and being provided with an inlet and an outlet both formed in the inner surface thereof, the inlet and the outlet being communicated through a heat transfer medium passage formed in the hot plate, each caterpillar including opposite turning portions;

connecting joints each connecting the outlet of a corresponding hot plate to the inlet of a following adjacent hot plate of the same group;

a pair of rotary shafts each having a proximal portion, each rotary shaft having a heat transfer medium supplying portion and a heat transfer medium discharging portion separately formed therein from one end thereof to the other end;

first connecting tubes, each communicating the supplying portion of a corresponding rotary shaft to the inlet of the leading hot plate of a corresponding caterpillar, the first connecting tube extendable to the turning portions of the corresponding caterpillar;

second connecting tubes, each communicating the discharging portion of a corresponding rotary shaft to the outlet of the trailing hot plate of a corresponding caterpillar, the second connecting tube extendable to the turning portions of the corresponding caterpillar;

supporting means for rotatably supporting the supplying rotary shafts and the discharging rotary shafts at the proximal portions to respective frames; and synchronous control means for synchronously controlling the rotary shaft and the caterpillar in such a manner that the rotary shaft makes a revolution for a turn of the caterpillar.

13. A plate treating apparatus as recited in claim 8, wherein:

there are provided pairs of the caterpillars arranged in series, each caterpillar including opposite ends in the conveying direction;

in each pair of the caterpillars, one caterpillar is arranged to project from the other caterpillar at one end, adjacent pairs of the caterpillars arranged close to each other in such a manner that adjacent projecting ends thereof overlap; and further comprising a guide member, bridging lower caterpillars of adjacent pairs of the caterpillars, for guiding a plate member to be heat treated.

14. A plate treating apparatus comprising:

a frame including a pair of parallel supporting shaft rotatably mounted thereon at an interval in an article conveying direction;

a caterpillar including a pair of sprocket wheels, mounted around respective supporting shafts, and a group of parallel strip shaped hot plates connected closely in an endless shape, each hot plate including an inner surface and provided in the inner surface with an inlet and outlet, each hot plate having a heat transfer medium passage formed therein to communicate the inlet and the outlet;

a heat transfer medium supplying header arranged within the endless-shaped group of the hot plates, the supplying header being deformable to conform to the endless shape of the group of the hot plates;

a first connecting tube connecting the supplying header to the inlet of each hot plate;

a heat transfer medium discharging header arranged within the endless-shaped group of the hot plates and being deformable to conform to the endless shape of the group of the hot plates, the supplying header and the discharging header being located in a transversely spaced manner;

a second connecting tube connecting the discharging header to the outlet of each hot plate;

a heat transfer medium circulating rotary shaft, rotatably mounted to the frame, for supplying and discharging the heat treating medium;

rotary joint means for rotatably jointing the rotary shaft to the supplying header to supply the heat transfer medium and for rotatably jointing the rotary shaft to the discharging header to receive the heat transfer medium from the discharging header; and synchronous control means for controlling the caterpillar and the rotary shaft in such a manner that the rotary shaft makes one revolution for a turn of the caterpillar.

15. A plate treating apparatus comprising:

a frame including a pair of parallel supporting shaft rotatably mounted thereon at an interval in an article conveying direction;

a pair of sprocket wheels, a caterpillar including a pair of sprocket wheels, mounted around respective supporting shafts, and a group of parallel strip shaped hot plates connected closely in an endless shape, each hot plate including an inner surface and provided in the inner surface with an inlet and outlet, each hot plate having a heat transfer medium passage formed therein to communicate the inlet and the outlet;

connecting joints each connecting the outlet of a corresponding hot plate to the inlet of a following adjacent hot plate of the same group;

a heat transfer medium supplying header arranged within the endless-shaped group of the hot plates, the supplying header being deformable to conform to the endless shape of the group of the hot plates;

a first connecting tube connecting the supplying header to the inlet of each hot plate;

a heat transfer medium discharging header arranged within the endless-shaped group of the hot plates and being deformable to conform to the endless shape of the group of the hot plates, the supplying header and the discharging header being located in a transversely spaced manner;

a second connecting tube connecting the discharging header to the outlet of each hot plate;

a heat transfer medium circulating rotary shaft, rotatably mounted to the frame, for supplying and discharging the heat treating medium;

rotary joint means for rotatably jointing the rotary shaft to the supplying header to supply the heat transfer medium and for rotatably jointing the rotary shaft to the discharging header to receive the heat transfer medium from the discharging header; and synchronous control means for controlling the caterpillar and the heat transfer medium circulating rotary shaft in such a manner that the heat transfer medium circulating rotary shaft makes one revolution for a turn of the caterpillar.

16. A plate treating apparatus comprising:

a frame having beams substantially horizontally projecting therefrom;

a first group of caterpillars operatively supported on respective beams in series in an article conveying direction, each caterpillar including a group of strip shaped hot plates connected together closely in parallel to each other in an endless manner, each hot plate including an outer surface and an inner surface, each hot plate having a plurality of grooves, formed in the outer surface thereof in parallel with the conveying direction, and an inlet and an outlet both formed in the inner surface thereof, the inlet and the outlet being communicated through a heat transfer medium passage formed in the hot plate, each caterpillar including opposite turning portions and an upper flat portion interposed between the turning portions, the caterpillars being arranged so that corresponding grooves of adjacent caterpillars are placed in alignment with each other;

a plurality of endless guide bands for guiding a plate member to be heat treated;

guiding means for guiding the guide bands to extend through respective grooves at the upper flat portion of each caterpillar;

a plurality of heat transfer medium circulating rotary shafts each having a heat transfer medium supplying portion and a heat transfer medium discharging portion separately formed therein from one end thereof to the other end, the heat transfer medium supply rotary shafts being supported on the frame to extend transversely into respective caterpillar;

a plurality of first connecting tubes each connecting the supply portion of a corresponding rotary shaft to the inlet of a corresponding hot plate, each first connecting tube extendable to the turning portions of a corresponding caterpillar;

a plurality of second connecting tubes each connecting the discharge portion of a corresponding rotary shaft to the outlet of a corresponding hot plate, each second connecting tube extendable to the turning portions of a corresponding caterpillar; and synchronous control means for synchronously controlling the rotary shaft and the caterpillar in such a manner that the rotary shaft makes a revolution for a turn of the caterpillar.

17. A plate treating apparatus as recited in claim 16, wherein:

the group of the hot plates includes a leading hot plate and a trailing hot plate;

the first connecting tubes each communicate the supply portion of a corresponding rotary shaft to the inlet of the leading hot plate of a corresponding caterpillar, each first connecting tube extendable to the turning portions of the corresponding caterpillar;

the second connecting tubes each communicate the discharging portion of a corresponding rotary shaft to the outlet of the trailing hot plate of a corresponding caterpillar, each second connecting tube extendable to the turning portions of the corresponding caterpillar, and further comprising connecting joints each connecting the outlet of a corresponding hot plate to the inlet of a following adjacent hot plate of the same group.

18. A plate treating apparatus as recited in claim 16, further comprising a second group of caterpillars having the same structure as the first group of the caterpillars and each caterpillar of the second group being arranged above a corresponding caterpillar of the first group in the conveying direction to vertically oppose to each other.

19. A plate treating apparatus comprising:

a frame;

a caterpillar arranged in an article conveying direction including a pair of chain conveyors, supported on the frame to extend in the conveying direction, and a group of strip shaped hot plates, connected together closely in parallel to each other in an endless manner, the group of the hot plates being secured to the chain conveyors to surround the chain conveyors, each hot plate including an inner surface and having an inlet and an outlet both formed in the inner surface thereof, the inlet and the outlet being communicated through a heat transfer medium passage formed in the hot plate, the caterpillar including opposite turning portions;

a rotary shaft including a heat transfer medium supplying portion and a heat transfer medium discharging portion separately formed therein from one end thereof to the other end;

a rotary joint for rotatably supporting the rotary shaft to the frame;

connecting tubes radially connected to the rotary shaft, the heat transfer medium supplying portion being communicated to the inlet of each hot plate through a corresponding connecting tube and the heat transfer medium discharging portion being communicated to the outlet of each hot plate through a corresponding connecting tube, the connecting means extendable to the turning portions of the caterpillar; and synchronous control means for synchronously controlling the rotary shaft and the caterpillar in such a manner that the rotary shaft makes a revolution for a turn of the caterpillar.

20. A plate treating apparatus comprising:

a frame;

a caterpillar arranged in an article conveying direction and including a pair of chain conveyors, extending around the supporting shafts spaced in the conveying direction, and a group of strip shaped hot plates, connected together closely in parallel to each other in an endless manner, the group of the hot plates being including a leading hot plate and a trailing hot plate, each hot plate having a heat transfer medium passage formed therein, and the group of the hot plates being mounted to the chain conveyors to surround the chain conveyors, each hot plate having an inner surface and being provided with an inlet and an outlet both formed in the inner surface thereof, the inlet and the outlet being communicated through a heat transfer medium passage formed in the hot plate, the caterpillar including opposite turning portions;

connecting joints each connecting the outlet of a corresponding hot plate to the inlet of a following adjacent hot plate of the same group;

a rotary shaft including a heat transfer medium supplying portion and a heat transfer medium discharging portion separately formed therein from one end thereof to the other end;

a rotary joint for rotatably supporting the rotary shaft to the frame;

a first connecting tube communicating the supplying portion of the rotary shaft to the inlet of the leading hot plate, the first connecting tube extendable to the turning portions of the caterpillar;

a second connecting tube communicating the discharging portion of the rotary shaft to the outlet of the trailing hot plate, the second connecting tube extendable to the turning portions of the caterpillar; and synchronous control means for synchronously controlling the rotary shaft and the caterpillar in such a manner that the rotary shaft makes one revolution for a turn of the caterpillar.

21. A plate treating apparatus as recited in claim 19, wherein there are provided a pair of the caterpillars disposed one above the other in an opposing manner.

22. A plate treating apparatus as recited in claim 19, further comprising flexible members each secured at opposite ends thereof to a corresponding connecting tube at respective positions attached to a corresponding hot plate and the rotary shaft, each of the flexible members being deformable to conform to a curvature of the turning portions of the caterpillar for protecting the corresponding connecting tube.

23. A plate treating apparatus as recited in claim 21, wherein said synchronous control means comprises said connecting tubes and said flexible members, said tubes and members being operative to transmit the turning movement of the caterpillar to the rotary shaft thereby to rotate the same.

24. A plate treating apparatus as recited in claim 19, wherein said synchronous control means comprises said connecting tubes which operate to transmit the turning movement of the caterpillar to the rotary shaft to turn the same.

25. A method of circulating a heat transfer medium through a caterpillar as recited in claim 2, wherein there are provided a pair of the caterpillars arranged one above the other.

26. A method of circulating a heat transfer medium through a caterpillar as recited in claim 3, wherein there are provided a pair of the caterpillars arranged one above the other.

27. A method of circulating a heat transfer medium through a caterpillar as recited in claim 4, wherein there are provided a pair of the caterpillars arranged one above the other.

28. A method of circulating a heat transfer medium through a caterpillar as recited in claim 5, wherein there are provided a pair of the caterpillars arranged one above the other.

29. A method of circulating a heat transfer medium through a caterpillar as recited in claim 2, further comprising a step of depressing an upper extension of the caterpillar by a depressing conveyor.

30. A method of circulating a heat transfer medium through a caterpillar as recited in claim 3, further comprising a step of depressing an upper extension of the caterpillar by a depressing conveyor.

31. A method of circulating a heat transfer medium through a caterpillar as recited in claim 4, further comprising a step of depressing an upper extension of the caterpillar by a depressing conveyor.

32. A method of circulating heat transfer medium through a caterpillar as recited in claim 5, further comprising a step of depressing an upper extension of the caterpillar by a depressing conveyor.

* * * * *